US010473106B2

(12) United States Patent
Parmeter et al.

(10) Patent No.: US 10,473,106 B2
(45) **Date of Patent: *Nov. 12, 2019**

(54) APPARATUS AND SYSTEM FOR SEALING SUBMERSIBLE PUMP ASSEMBLIES

(71) Applicant: Halliburton Energy Services, Inc., Houston, TX (US)

(72) Inventors: Larry James Parmeter, Broken Arrow, OK (US); Brett D. Leamy, Claremore, OK (US); John Vanderstaay Kenner, Houston, TX (US); David J. Lunk, Big Cabin, OK (US); Keith Leon Johnson, Claremore, OK (US); Thomas John Gottschalk, Houston, TX (US); Wesley John Nowitzki, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 339 days.

This patent is subject to a terminal disclaimer.

(21) Appl. No.: 14/860,510

(22) Filed: Sep. 21, 2015

(65) Prior Publication Data

US 2016/0010439 A1 Jan. 14, 2016

Related U.S. Application Data

(63) Continuation-in-part of application No. 14/657,835, filed on Mar. 13, 2015, now Pat. No. 9,169,848,
(Continued)

(51) Int. Cl.
*F04D 13/10* (2006.01)
*E21B 43/12* (2006.01)
(Continued)

(52) U.S. Cl.
CPC ..... *F04D 13/10* (2013.01); *E21B 43/128* (2013.01); *F04D 7/04* (2013.01); *F04D 29/047* (2013.01);
(Continued)

(58) Field of Classification Search
CPC ..... F04D 29/04; F04D 29/08; F04D 29/086; F04D 29/106; F04D 29/12; F04D 13/08;
(Continued)

(56) References Cited

U.S. PATENT DOCUMENTS 5,367,214 A * 11/1994 Turner, Jr. ..... F04B 43/082 310/87
5,404,061 A * 4/1995 Parmeter ..... E21B 4/003 251/349

(Continued)

*Primary Examiner* — Kenneth J Hansen
(74) *Attorney, Agent, or Firm* — McGuireWoods LLP

(57) ABSTRACT

An apparatus and system for sealing an electrical submersible pump (ESP) assembly are described. An ESP system includes a top portion of a seal section including a sand barrier portion defined by a sand barrier stop secured between the ESP intake and an adapter portion, the sand barrier portion including a sand barrier wedged between the sand barrier stop and the adapter portion, the adapter portion encasing a mechanical seal and secured between the sand barrier portion and a head portion, the head portion secured between the adapter portion and a seal section housing, the head portion including a thrust bearing and a thrust runner, wherein each of the thrust bearing and the thrust runner includes at least one pad having a diamond-like carbon (DLC) layer on an outer surface.

22 Claims, 16 Drawing Sheets

Related U.S. Application Data which is a continuation of application No. 14/274,233, filed on May 9, 2014, now Pat. No. 9,017,043.

(60) Provisional application No. 61/974,907, filed on Apr. 3, 2014, provisional application No. 61/822,085, filed on May 10, 2013, provisional application No. 62/210,068, filed on Aug. 26, 2015.

(51) Int. Cl.

| | |
|---|---|
| ***F04D 29/10*** | (2006.01) |
| ***F04D 7/04*** | (2006.01) |
| ***F04D 29/047*** | (2006.01) |
| ***F04D 29/12*** | (2006.01) |
| ***F04D 29/041*** | (2006.01) |

(52) U.S. Cl.
CPC ..... *F04D 29/0413* (2013.01); *F04D 29/106* (2013.01); *F04D 29/126* (2013.01)

(58) Field of Classification Search
CPC .... F04D 29/041; F04D 29/0413; F04D 13/10; E21B 43/128
See application file for complete search history.

(56) References Cited

U.S. PATENT DOCUMENTS

| | | | | |
|---|---|---|---|---|
| 6,602,059 | B1 * | 8/2003 | Howell | F04B 47/06 184/6.21 |
| 2007/0140876 | A1 * | 6/2007 | Parmeter | F04D 13/10 417/423.11 |
| 2009/0041597 | A1 * | 2/2009 | Brunner | F01C 1/107 417/410.1 |
| 2010/0218995 | A1 * | 9/2010 | Sexton | E21B 4/003 175/57 |
| 2011/0024198 | A1 * | 2/2011 | Dick | E21B 4/003 175/371 |
| 2013/0192899 | A1 * | 8/2013 | Cooley | F16C 17/03 175/92 |
| 2016/0177959 | A1 * | 6/2016 | Marya | F04D 29/026 415/177 |

* cited by examiner

APPARATUS AND SYSTEM FOR SEALING SUBMERSIBLE PUMP ASSEMBLIES

CROSS REFERENCE TO RELATED APPLICATIONS

The present application is a continuation-in-part of U.S. Ser. No. 14/657,835 to Parmeter et al., filed Mar. 13, 2015 and entitled APPARATUS AND SYSTEM FOR SEALING SUMBERSIBLE PUMP ASSEMBLIES, which is a continuation of U.S. Ser. No. 14/274,233 to Parmeter et al., filed May 9, 2014 and entitled APPARATUS AND SYSTEM FOR SEALING SUBMERSIBLE PUMP ASSEMBLIES, now U.S. Pat. No. 9,017,043, which claims the benefit of U.S. Provisional Application No. 61/822,085 to Parmeter et al., filed May 10, 2013 and entitled "APPARATUS, SYSTEMS AND METHODS FOR SEALING SUBMERSIBLE PUMP ASSEMBLIES," and U.S. Provisional Application No. 61/974,907 to Lunk et al., filed Apr. 3, 2014 and entitled "APPARATUS, SYSTEM AND METHOD FOR A HYDRODYNAMIC THRUST BEARING FOR USE IN HORIZONTAL PUMP ASSEMBLIES," which are each hereby incorporated by reference in their entireties. The present application claims the benefit of U.S. Ser. No. 62/210,068 to Lunk et al. filed Aug. 26, 2015 and entitled ABRASION RESISTANCE IN WELL FLUID WETTED ASSEMBLIES, which is hereby incorporated by reference in its entirety.

BACKGROUND OF THE INVENTION

1. Field of the Invention

Embodiments of the invention described herein pertain to the field of submersible pumps. More particularly, but not by way of limitation, one or more embodiments of the invention enable an apparatus and system for sealing submersible pump assemblies.

2. Description of the Related Art

Electric submersible pump (ESP) assemblies are used to artificially lift fluid to the surface in deep underground wells such as oil, water or gas wells. Exemplary downhole oil well fluid, for example, may include a mixture of oil, water and natural gas. A typical ESP assembly is shown in FIG. 1, consisting of electric motor 100, conventional seal section 110, pump intake 120 and centrifugal pump 130, which are all connected together with rotatable shafts. Electric motor 100 supplies torque to the shafts, which provides power to pump 130.

Submersible pumps operate while submerged in the fluid to be pumped. The fluid enters the assembly at pump intake 120 and is lifted to the surface through production tubing 140. In order to function properly, electric motor 100 must be protected from well fluid ingress, and conventional seal section 110 provides a barrier to keep the well fluid from the motor and its motor oil. In addition, conventional seal section 110 supplies oil to the motor, provides pressure equalization to allow for expansion of motor oil in the well bore, and carries the thrust of pump 130 through the use of thrust bearings. A conventional multi-chamber seal section is further illustrated in FIG. 11. Conventional seal section 110 of FIG. 11 includes conventional head 1125, three conventional seal chambers 1130, a conventional thrust chamber 1120 and conventional base 1135. Conventional seal chambers 1130 are attached to one another and conventional thrust chamber 1120 with modular seal body 1155. As illustrated in FIG. 11, conventional thrust chamber 1120 is located at the bottom-most section of conventional seal chamber 110 and connected to motor 100 by conventional base 1135.

In many instances, naturally occurring sand is pulled into the pump assembly along with the well fluid and can accumulate in production tubing 140. When the pump is shut down, the sand may fall back down through the pump assembly and accumulate in conventional head 1125, at the top of seal section 110, which is traditionally open to the accumulation of debris, and includes conventional mechanical seal 1110 and conventional vent port 1105. As shown in FIG. 11, sand can accumulate at the top of conventional mechanical seal 1110 due to conventional seal section 110's open design, destroying mechanical seal 1110.

This accumulation of sand may also plug the conventional vent port 1105, which vents to conventional mechanical seal 1110. Vent ports function to provide an outlet for expanding motor oil into the well bore, in order to maintain equalized pressure. Pressure equalization may be accomplished by utilizing a u-tube or elastomeric bag design. In either case, the expanding oil is released through an internal check valve located inside conventional vent port 1105. If the vent port is blocked off by sand, conventional seal section 110 cannot equalize pressure, causing a pressure build up inside conventional seal section 110, such that conventional mechanical seal 1110 faces may eventually separate. If this occurs, well fluid and sand will enter the clean oil section of conventional seal section 110 (upstream of conventional mechanical seal 1110), impeding the seal's proper function which may lead to failure of the pump and motor.

Accumulation of sand may also prevent well fluid from making contact with the faces of conventional mechanical seal 1110 of conventional seal section 110. Mechanical seal 1110 faces must be in contact with well fluid to remain cool during operation. In the instance that sand compacts around the mechanical seal and prevents heat transfer with the well fluid, the sealing faces will overheat and cause failure of the seal whether or not the vent port is plugged. In addition, conventionally a bronze bushing (not shown) is located in conventional head 1125, just below the mechanical seal, to provide radial support. Well fluid contamination and sand will rapidly destroy the bushing, causing a catastrophic failure due to loss of radial shaft support.

As is apparent from the drawbacks of conventional designs, seal sections of submersible pump assemblies are unduly susceptible to damage and contamination by sand and well fluid. One conventional approach to address this drawback has been to add a plate over the top of conventional head 1125. Such plates capture a portion of sand that would otherwise fall into the seal section, but they also prevent cooling well fluid from exchanging heat with the mechanical seal. In addition, plates over the seal section do not adequately prevent sand from entering, as they are prone to leaks.

Another approach to address this drawback has been to include multiple seal chambers in order to provide redundancy. As shown in FIG. 11, three conventional seal chambers 1130 are included in conventional seal section 110. In multiple chamber designs, thrust bearings are conventionally located at the bottom most section of the seal assembly, close to the motor in conventional thrust chamber 1120. In FIG. 11, a conventional upthrust bearing 1150, conventional thrust runner 1145 and conventional downthrust bearing 1140 are included in conventional thrust chamber 1120. As shown in FIG. 11, conventional thrust chamber 1120 is in close proximity to motor 100. With the multi-chamber approach, if one chamber should fail and allow well fluid to enter that chamber, the succeeding chamber will still isolate well fluid and the conventional bearings 1140, 1150 remain protected from contamination until the last chamber is breached. However, the result of the multi-chamber designs is that the shaft is very long and slender, which may cause incipient buckling. If this occurs, the side load capacity of the bronze bushings may be overcome as the shaft tries to buckle, causing pump failure.

Additionally, the location of conventional downthrust thrust bearing 1140, conventional thrust runner 1145 and conventional upthrust bearing 1150 in close proximity to the motor exposes the bearings to excessive amounts of heat. The conventional thrust bearings 1140, 1150, traditionally located at the bottom-most section of the seal assembly, sit immersed in clean motor oil to handle the thrust of the pump. Thrust bearings in the seal section carry the axial thrust and maintain shaft alignment. Hydrodynamic bearings are the most commonly implemented thrust bearings in submersible pump applications.

A conventional hydrodynamic bearing includes two round disks, which are usually submerged in a cavity of clean motor oil. One disk is fixed, while the other is turned by the shaft in rotation about the central axis of the fixed disk. An exemplary conventional thrust bearing of the prior art is illustrated in FIGS. 12A and 12B. Conventional downthrust bearing 1140 is illustrated in FIGS. 12A and 12B, but traditionally, conventional upthrust bearing 1150 would be identical except installed in conventional seal section 110 facing in the opposite direction of conventional downthrust bearing 1140. In some approaches, the fixed disk (conventional downthrust and upthrust bearings 1140, 1150) is designed with bronze pads. The rotating disk pulls motor oil between the pads and the stationary disk. As long as there is motor oil between the surfaces, the thin film of fluid creates separation between the disks with hydrodynamic lift. To function properly, the surfaces of hydrodynamic bearings must be flat and smooth. A typical hydrodynamic thrust bearing is usually designed to operate with a fluid thickness of between about 0.001 and 0.0004 inches. Any impurities that are thicker than the oil film between the disks, such as sand in the motor oil, can cause surface damage to the bearings. Resulting friction between the disks reduces or eliminates their hydrodynamic properties. Contamination of the motor oil between the disks, for example with sand, is common due to typical oil field conditions and oil or water pump requirements. Placing the disks in a protected cavity usually means locating the disks closer to the motor, exposing the disks to increased heat.

The rotating disk of a hydrodynamic thrust bearing is typically a hard material such as tungsten carbide. The stationary disk, conventional downthrust bearing 1140 and conventional upthrust bearing 1150, typically include softer metal pads made of bronze. However, bronze is only capable of carrying a load of about 500 pounds per square inch. There is often insufficient space to include large enough copper pads on the stationary disk to carry the required loads.

Conventional thrust bearings are not well suited for submersible pump applications since they must be operated in a cavity of clean motor oil uncontaminated by sand, dirt or water. In submersible pump applications where solid laden fluid is pumped, this means placing the thrust bearings close to the motor in a cavity of clean motor oil, which is not an ideal location for carrying thrust and maintaining shaft alignment.

Thus, it is apparent that conventional sealing techniques do not satisfactorily provide protection from sand contamination in submersible pump assemblies. Therefore, there is a need for an additional apparatus and system for sealing submersible pump assemblies.

BRIEF SUMMARY OF THE INVENTION

One or more embodiments of the invention enable an apparatus and system for sealing submersible pump assemblies.

An apparatus and system for sealing submersible pump assemblies are described. An illustrative embodiment of a seal section for an electric submersible pump assembly includes a rotatable shaft extending axially through a seal section, a top portion of the seal section including a sand barrier substantially sealed from leaks on an inner and outer diameter, a sand barrier stop extending longitudinally around the outer diameter of the sand barrier, the sand barrier stop coupled to a centrifugal pump intake, an adapter secured between the sand barrier stop and a head, the sand barrier wedged between the sand barrier stop and the adapter, a mechanical seal coupled to the rotatable shaft within the adapter, the head tubularly surrounding a bearing set and coupled to a seal section body, wherein the bearing set further includes a thrust bearing coupled to the head and a thrust runner keyed to the rotatable shaft. In some embodiments, the thrust runner includes a base comprising a disc-shaped impression, a runner pad fit within the impression, and a diamond-like carbon layer on an outer surface of the runner pad. In certain embodiments, the sand barrier is coupled to the rotatable shaft on an inner diameter and the adapter on an outer diameter. In some embodiments, the outer diameter of the sand barrier is sandwiched between the sand barrier stop and the adapter.

An illustrative embodiment of an electric submersible pump (ESP) system for pumping solid-laden fluid includes a top portion of a seal section secured on a downstream side to an ESP intake, the top portion including a sand barrier portion defined by a sand barrier stop, the sand barrier stop secured between the ESP intake and an adapter portion, the sand barrier portion including a sand barrier sealedly coupled to a rotatable shaft on an inner diameter and sandwiched between the sand barrier stop and the adapter portion on an outer diameter, the adapter portion tubularly encasing a mechanical seal, the adapter portion secured between the sand barrier portion and a head portion, the head portion secured between the adapter portion and a seal section housing, the head portion including a bearing set, the bearing set including a thrust bearing and a thrust runner, wherein each of the thrust bearing and the thrust runner includes at least one pad, and the at least one pad of each of the thrust bearing and the thrust runner including a diamond-like carbon (DLC) layer on an outer surface such that the DLC layer on the thrust bearing faces the DLC layer on the thrust runner. In some embodiments, the DLC layer is one of a physical vapor deposition or a plasma-assisted chemical vapor deposition. In certain embodiments, the at least one pad of the thrust runner is a single disc-shaped runner pad.

An illustrative embodiment of an apparatus for absorbing a thrust of an electric submersible pump (ESP) includes an ESP configured to pump a well fluid, an electric motor operatively coupled to the ESP, the motor operating to rotate a shaft of the ESP, a seal section located between the ESP and the motor, the seal section including a thrust bearing including a plurality of bearing pads, wherein each of the plurality of bearing pads has a diamond-like carbon layer on an outer surface of the bearing pad, a thrust runner paired with the thrust bearing to form a bearing set, wherein the thrust runner rotates with the shaft, the thrust runner comprising a single runner pad secured within an impression in a thrust runner base, wherein the single pad has a diamond-like carbon layer on an outer surface of the single runner pad. In some embodiments, the diamond-like carbon layer on the outer surface of the bearing pads and the runner pad is a physical vapor deposition layer. In certain embodiments, the diamond-like carbon layer on the outer surface of the bearing pads and the runner pad is a plasma-assisted chemical vapor deposition layer. In some embodiments, the single runner pad is disc-shaped. In certain embodiments, the head is secured between an adapter and a seal section housing, and wherein the adapter comprises a mechanical seal. In some embodiments, the adapter is secured between the head and a sand barrier stop and the sand barrier stop is secured to an intake of the ESP.

An illustrative embodiment of an apparatus for absorbing a thrust of an electric submersible pump (ESP) includes an ESP configured to pump a well fluid, an electric motor operatively coupled to the ESP, the motor operating to rotate a shaft of the ESP, a seal section located between the ESP and the motor, the seal section including a thrust bearing comprising a plurality of bearing pads, wherein each of the plurality of bearing pads has a diamond-like carbon layer on an outer surface of the bearing pad, a thrust runner paired with the thrust bearing to form a bearing set, wherein the thrust runner rotates with the shaft, the thrust runner comprising a plurality of runner pads, wherein each of the plurality of runner pads has a diamond-like carbon layer on an outer surface of the runner pad. In some embodiments, the diamond-like carbon layer comprises a vapor deposition of diamond-like carbon. In certain embodiments, the thrust bearing and thrust runner are located in one of a head or an adapter of the seal section.

An illustrative embodiment of a seal section for an electric submersible pump assembly includes a rotatable shaft extending axially through a seal section, a top portion of the seal section including an adapter secured between a pump intake and a head of the seal section, a mechanical seal coupled to the rotatable shaft within the adapter, the head tubularly surrounding a bearing set and coupled to a seal section housing, wherein the bearing set further includes a thrust bearing coupled to the head and a thrust runner keyed to the rotatable shaft. In some embodiments, one of the thrust bearing or the thrust runner comprises a diamond-like carbon layer. In certain embodiments, the diamond-like carbon layer is a vapor deposition of diamond-like carbon. In some embodiments, each of the thrust bearing and the thrust runner comprise a diamond-like carbon layer.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
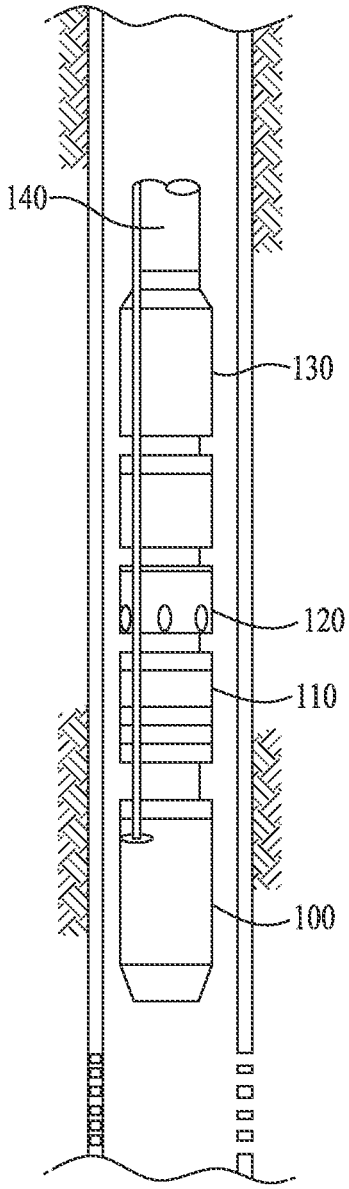
FIG. 1 PRIOR ART
FIG. 1 is a schematic side view of a conventional electric submersible pump assembly of the prior art.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

An apparatus and system for sealing submersible pump assemblies will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to an aperture includes one or more apertures.

As used in this specification and the appended claims, the term "diamond" includes true diamond as well as other natural or manmade diamond-like carbon materials, which may have a crystalline, polycrystalline and/or graphite structure. "Diamond coating" and "diamond coated" as used herein is intended to encompass composites of diamond in combination with other materials and having at least 5% pure diamond by weight.

As used herein, the terms "sand", "debris", "dirt", "particles", and "solids" are used interchangeably to refer to solid contamination in pumped well fluid.

As used herein, the term "outer" or "outward" means the radial direction away from the shaft of the ESP pump assembly. In the art, "outer diameter" and "outer circumference" are sometimes used equivalently. As used herein, the outer diameter is used to describe what might otherwise be called the outer circumference of a pump component such as a thrust bearing, thrust runner or sand barrier.

As used herein, the term "inner" or "inward" means the radial direction towards the shaft of the ESP pump assembly. In the art "inner diameter" and "inner circumference" are sometimes used equivalently. Herein, the inner diameter is used to describe what might otherwise be called the inner circumference of a pump component such as a thrust bearing, thrust runner or sand barrier.

"Coupled" refers to either a direct connection or an indirect connection (e.g., at least one intervening connection) between one or more objects or components. The phrase "directly attached" means a direct connection between objects or components.

"Downstream" refers to the direction substantially with the principal flow of well fluid when the submersible pump assembly is in operation. The "top" of a component of an ESP assembly refers to the downstream portion of that component. By way of example but not limitation, in a vertical downhole ESP assembly, the downstream direction may be towards the surface of the well.

"Upstream" refers to the direction substantially opposite the principal flow of well fluid when the submersible pump assembly is in operation. The "bottom" of a component of an ESP assembly refers to the upstream portion of that component. By way of example but not limitation, in a vertical downhole ESP assembly, the upstream direction may be opposite the surface of the well.

One or more embodiments of the invention provide an apparatus and system for sealing submersible pump assemblies. While for illustration purposes the invention is described in terms of a submersible pump assembly, nothing herein is intended to limit the invention to that embodiment. The invention may be equally applicable to any pump assembly and/or electric motor which must be sealed from fluids and/or particulate contamination, such as a horizontal surface pump assembly.

The invention disclosed herein includes an apparatus and system for sealing submersible pump assemblies. Illustrative embodiments improve the performance of an ESP seal section, particularly when pumping solid-laden well fluid. Improvements to the seal section of a submersible pump assembly may include a fixed (stationary) sand barrier in the head of the seal section, downstream of a mechanical seal, the sand barrier sealed from leaks to prevent sand from falling down production tubing and accumulating on the mechanical seal. A diamond-coated thrust bearing and thrust runner may be located in a thrust chamber created between the sand barrier and the mechanical seal, in the seal section head away from the motor, to reduce buckling of the assembly. Well fluid flowing through this thrust chamber may serve as a hydrodynamic fluid for the bearing set, which bearing set, unlike conventional hydrodynamic bearings, need not be located in a clean chamber of motor oil. One or more horizontal apertures in the head of the seal section may allow well fluid to lubricate and cool the thrust bearing and/or mechanical seal, act as a hydrodynamic fluid and/or flush away accumulated debris. A vent port for venting expanding motor oil, may be located in the wall of the head of the seal section upstream of the mechanical seal, run substantially perpendicular to the shaft, be fluidly coupled to the communication port and/or prevent sand from plugging the communication port of the seal section. A tungsten carbide bushing set upstream of the mechanical seal may provide radial support in contaminated well fluid conditions.

Figure 2:
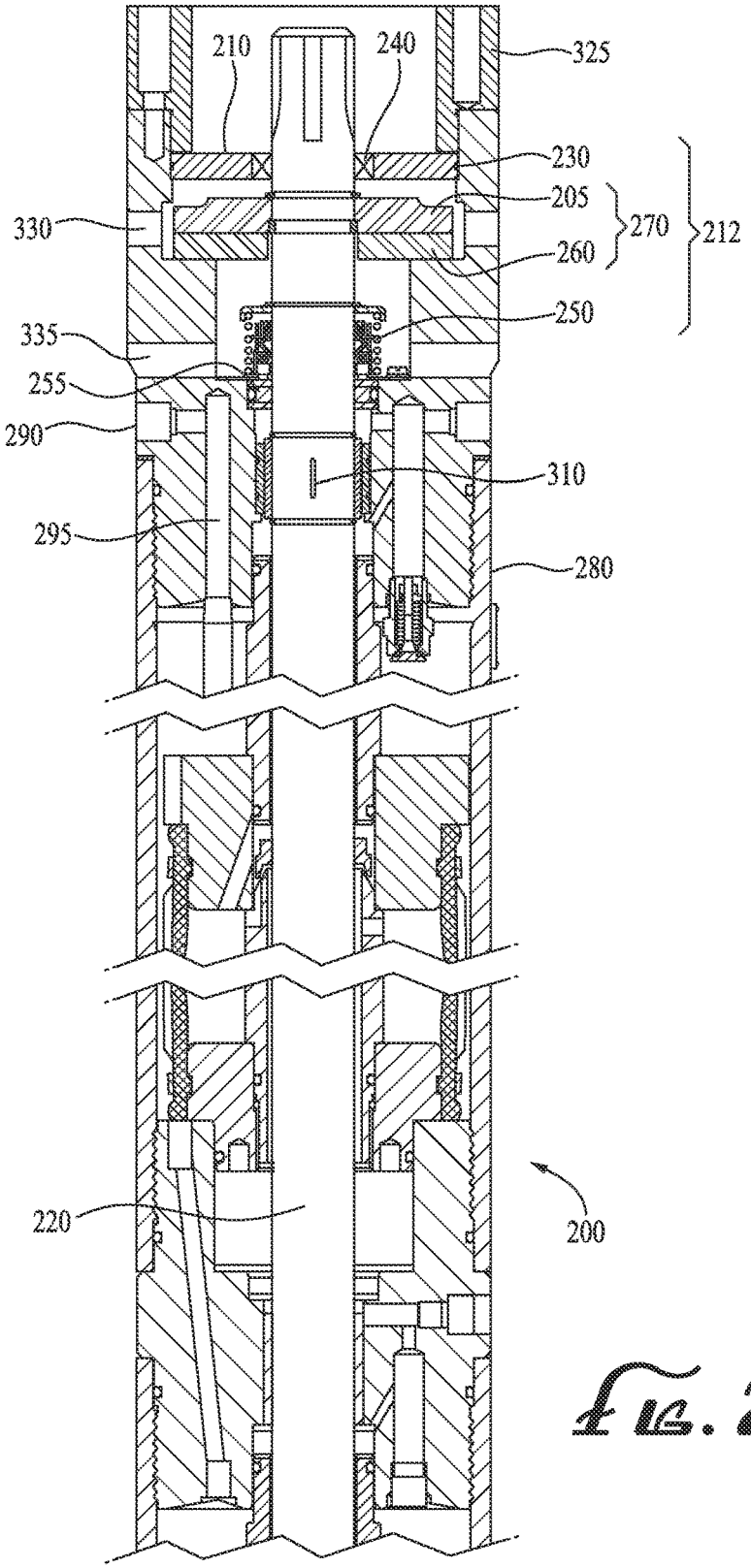
FIG. 2 is an illustrative embodiment of a sectional view of a seal section of a submersible pump assembly.
Figure 3A:
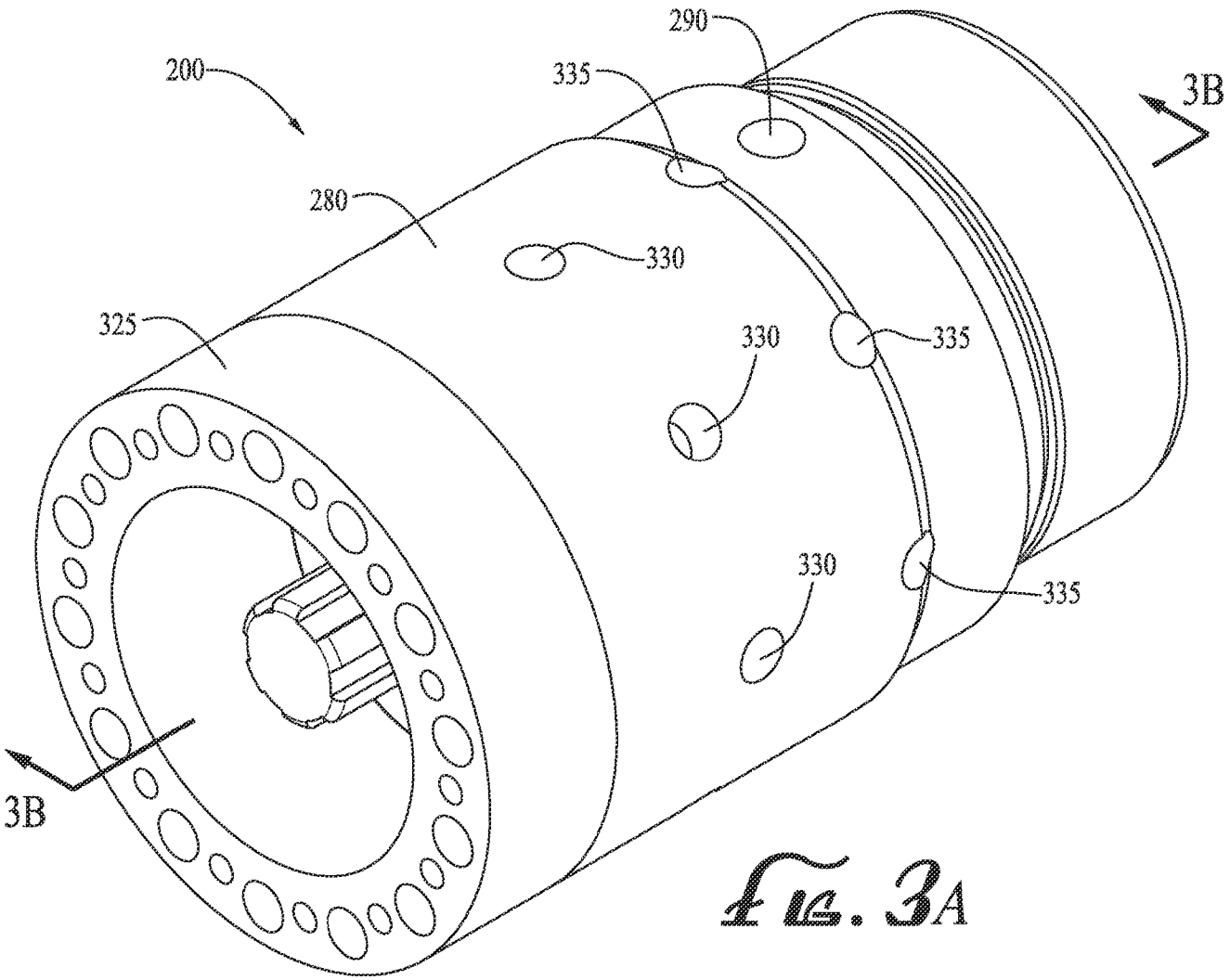
FIG. 3A is an illustrative embodiment of a perspective view of a top of a seal section.
Figure 3B:
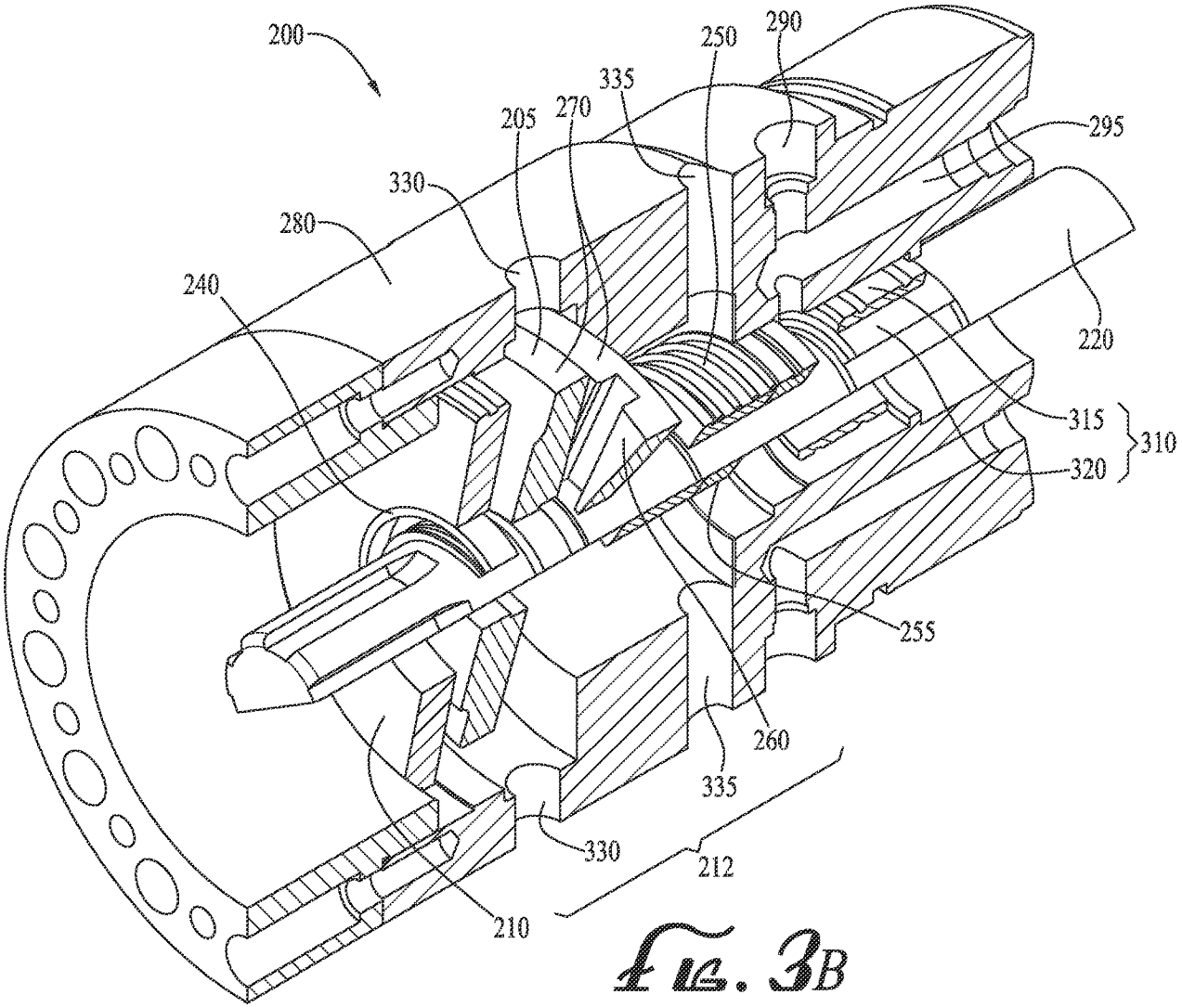
FIG. 3B is a cross sectional view taken along line 3B-3B of FIG. 3A of an illustrative embodiment of a top of seal section.

The invention includes an apparatus for sealing submersible pump assemblies. FIGS. 2, 3A and 3B illustrate a top portion of a seal section of illustrative embodiments. Seal section 200 may be part of an ESP assembly and coupled to an electric motor well known to those of skill in the art on an upstream side, and a centrifugal pump, ESP charge pump and/or pump intake well known to those of skill in the art on a downstream side. For example, the electric motor may be a two-pole, three-phase, squirrel cage induction motor, or a permanent magnet motor. The ESP pump may be a multi-stage centrifugal pump. The intake for the ESP assembly may be a bolted-on or integral intake.

Seal section 200 may be a seal section of a submersible pump assembly located in a downhole well, such as an oil, water and/or gas well. As shown in FIG. 2, seal section 200 includes shaft 220 running axially through the center of seal section 200. During operation of the ESP assembly, shaft 220 rotates about its vertical axis. The ESP motor and ESP pump of the ESP assembly similarly contain rotating shafts, which are all connected such that the motor turns the pump and the pump lifts fluid to the surface of the well. Head 280 encases the top portion of seal section 200 in a tubular fashion. Head 280 may comprise steel bar stock. In some embodiments the bar stock may have a 4 inch diameter. Head 280 may be machined and its top side and threaded to the ESP pump, ESP charge pump and/or ESP intake. The bottom side of head 280 may be pinned, bolted, threaded or otherwise attached to the first seal chamber of seal section 200. In some embodiments, head 280 is attached, threaded and/or bolted at a downstream side to the pump intake. The base (not shown) of seal section 200 may be threaded and/or bolted to the electric motor the ESP assembly.

Sand Barrier

As shown in FIGS. 2 and 3B, seal section 200 may include sand barrier 210. Sand barrier 210 may be fixed in place and/or may not rotate with shaft 220. Sand barrier 210 may be sealed from leaks, such that well fluid and/or its associated solids may not fall upstream, down the production tubing, and accumulate on mechanical seal 250 and/or mechanical seal faces 255. Instead, sand barrier 210 may catch accumulating debris, keeping the debris away from more vital seal section components, such as thrust bearing 260, thrust runner 205 and mechanical seal 250. The outer circumference (outer diameter) of sand barrier 210 may be pressed against the inner side of the wall of head 280 and sealed with gasket 230, such as an o-ring. Gasket 230 may be inserted into an o-ring groove in head 280. The inner circumference (inner diameter) of sand barrier 210 may be sealed against shaft 220 with radial shaft seal 240 (lip seal) to prevent sand from leaking through the barrier while still allowing shaft 220 to rotate. Sand barrier 210 may prevent sand, well fluid and/or other particulates carried in well fluid from bypassing the barrier and collecting on thrust bearing 260, thrust runner 205 and/or mechanical seal 250. In some embodiments, sand barrier 210 is stainless steel grade 316 and about ⅜ inch thick. Adapter 325 may be located at, on or near the top of head 280 and assists in holding sand barrier 210 in place, for example by preventing shaking or sliding of sand barrier 210 and/or by wedging or sandwiching sand barrier 210 against head 280.

Seal Section Thrust Chamber

Bearing set 270, including thrust bearing 260 and thrust runner 205, may be located in thrust chamber 212 of seal section 200, the thrust chamber 212 created by and located between sand barrier 210 and mechanical seal 250. Bearing set 270 (thrust bearing 260 and thrust runner 205) may reduce or eliminate incipient buckling of shaft 220, even in the instances where there are multiple seal chambers in the pump assembly. Thrust bearing 260 and thrust runner 205 may be located in thrust chamber 212 substantially adjacent and/or downstream of mechanical seal 250 within head 280, and/or between mechanical seal 250 and sand barrier 230. Locating thrust bearing 260 and thrust runner 205 near and/or in the top (downstream) portion of seal 200 and/or in head 280, rather than in the bottom-most seal section chamber (adjacent to the base) next to the motor, eliminates buckling concerns and removes thrust bearing 260 and thrust runner 205 from the heat generated by the pump's motor. In some embodiments, placing bearing set 270 in thrust chamber 212 keeps bearing set 270 in excess of about 100 degrees Fahrenheit cooler as compared to conventional locations in the base of the seal section and/or close to the motor of the pump assembly. Instead of conventional bearings, low cost spacers may be included in the bottom-most seal chamber by the motor, to momentarily absorb upthrust and keep the shaft in the correct position during start-up. Thrust bearing 260 and thrust runner 205 may be hydrodynamic thrust bearings making use of well fluid as the hydrodynamic film. In such embodiments, thrust bearing 260 and/or thrust runner 205 may be diamond coated and/or solid tungsten carbide for increased strength. In some embodiments, only a single thrust bearing 260 and a single thrust runner 205 are necessary, rather than conventional arrangements requiring separate upthrust and downthrust bearings.

Thrust Chamber Apertures

Entry aperture 330 and exit aperture 335 may be cross-drilled into head 280 of seal section 200 to allow well fluid, otherwise sealed off by sand barrier 230, to cool and lubricate thrust bearing 260, thrust runner 205 and/or mechanical seal 250. Entry aperture 330 may be located proximate and/or radially outwards from bearing set 270. Exit aperture 335 may be located proximate and/or radially outwards from mechanical seal 250. In some embodiments, apertures 330, 335 may extend in a radial direction, as judged from shaft 220, through the wall of head 280. Apertures 330, 335 may be cross-drilled substantially perpendicular to shaft 220, extending entirely through the wall of head 280. Entry aperture 330 may allow well fluid to lubricate and cool thrust bearing 260, thrust runner 205 and/or mechanical seal 250 without allowing the well fluid to contaminate the electrical motor and/or without allowing sand to accumulate on mechanical seal 250. Exit aperture 335 may allow accumulated debris to be flushed away from mechanical seal 250 and/or mechanical seal faces 255 with well fluid when the pump assembly is stopped. In such instances, well fluid may back flow through the bottom end of the pump due to gravity and flush any debris (solids) around mechanical seal 250 and/or mechanical seal faces 255.

Bearings

Figure 10:
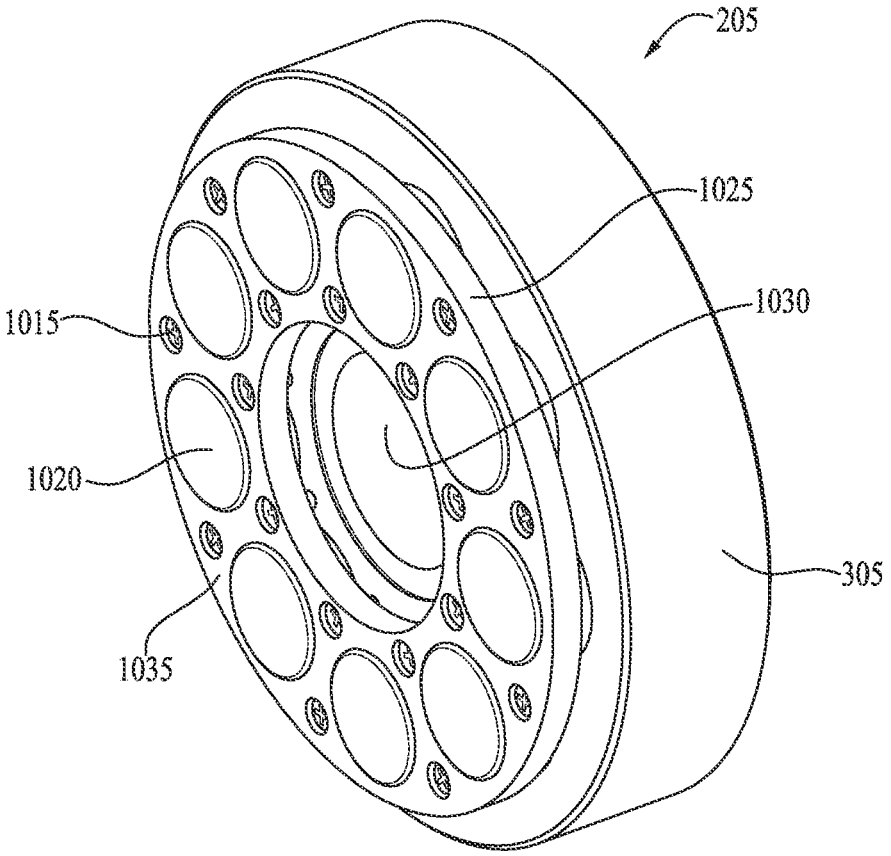
FIG. 10 is a perspective view of a thrust runner of an illustrative embodiment.

FIG. 10 is an exemplary thrust runner of an illustrative embodiment. As shown in FIG. 10, thrust runner 205 includes runner base 305, which may be keyed to shaft 220 (shown in FIG. 2). Runner locking plate 1025 is secured to base 305. In some embodiments, runner locking plate 1025 may be secured to runner base 305 with a series of screws 1015. Screws 1015 may additionally secure runner pads 1020 into place. A plurality of runner pads 1020 may be arranged circumferentially about runner locking plate 1025, for example as illustrated in FIG. 10. In some embodiments nine runner pads 1020 are arranged about runner locking plate 1025. In other embodiments, at least three runner pads 1020 are arranged about runner locking plate 1025. The size and number of runner pads 1020 may depend upon the size of the surface area of runner face 1035 and/or runner locking plate 1025. In some embodiments, runner pads 1020 include a circular surface area and are distributed uniformly around central opening 1030 of base 305, through which shaft 220 will run. Runner pads 1020 may be circular in surface area and be 9 mm, 16 mm, ½ inch, ⅝ inch, and/or ¾ inch in diameter. The number of runner pads 1020 may vary depending on the diameter of the overall bearing. In some embodiments runner pads 1020 may be made with different profiles other than round, for example a sector of a circle or a modified ellipse.

Figure 4:
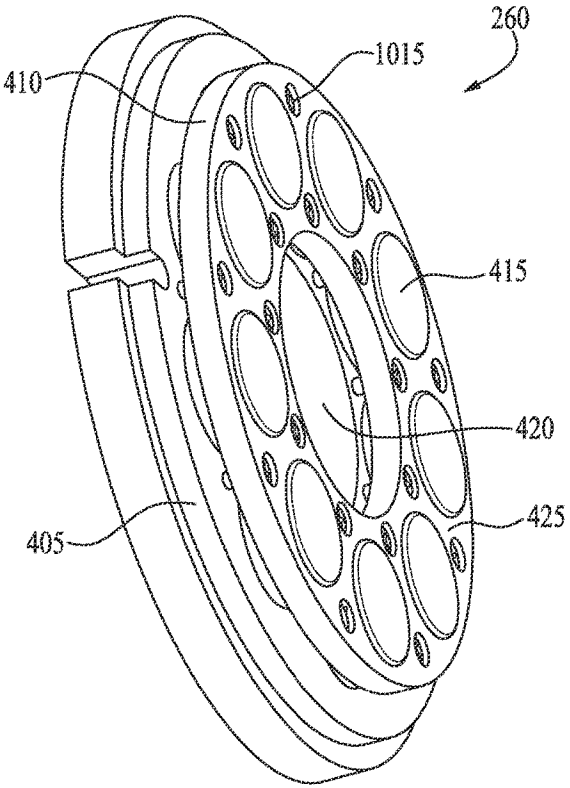
FIG. 4 is a perspective view of an illustrative embodiment of a thrust bearing.

An illustrative embodiment of thrust bearing 260 is shown in FIG. 4. Thrust bearing 260 may remain stationary during operation of the pump assembly. Thrust bearing 260 includes bearing holder 405, to which bearing locking plate 410 is secured. As with thrust runner 205, in some embodiments, bearing locking plate 410 may be secured to bearing holder 405 with a series of screws 1015. Screws 1015 may additionally secure bearing pads 415 into place. A plurality of bearing pads 415 may be arranged circumferentially about bearing locking plate 410, for example as illustrated in FIG. 4. In some embodiments nine bearing pads 415 are arranged about bearing locking plate 410. In other embodiments, at least three bearing pads 415 are arranged about bearing locking plate 410. The size and number of bearing pads 415 may depend upon the size and/or cross-sectional area of bearing face 423 and/or bearing locking plate 410. In some embodiments, bearing pads 415 include a circular surface area and are distributed uniformly around opening 420 of bearing holder 405. Bearing pads 415 may be circular in surface area and be 9 mm, 16 mm, ½ inch, ⅝ inch, and/or ¾ inch in diameter. The number of bearing pads 415 may vary depending on the diameter and/or circumference of the overall bearing. In some embodiments bearing pad 415 may be made with different profiles other than round, for example a sector of a circle or a modified ellipse.

Figure 5A:
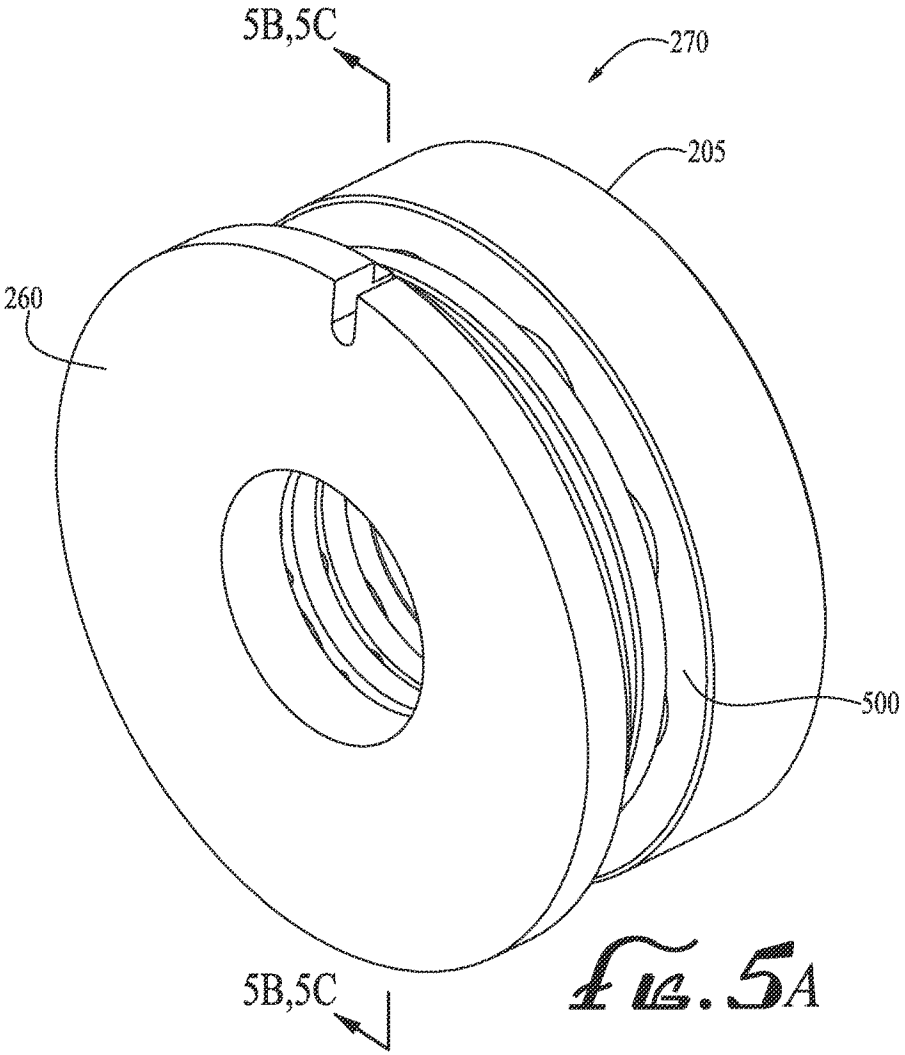
FIG. 5A is a perspective view of a bearing set of an illustrative embodiment.
Figure 5C:
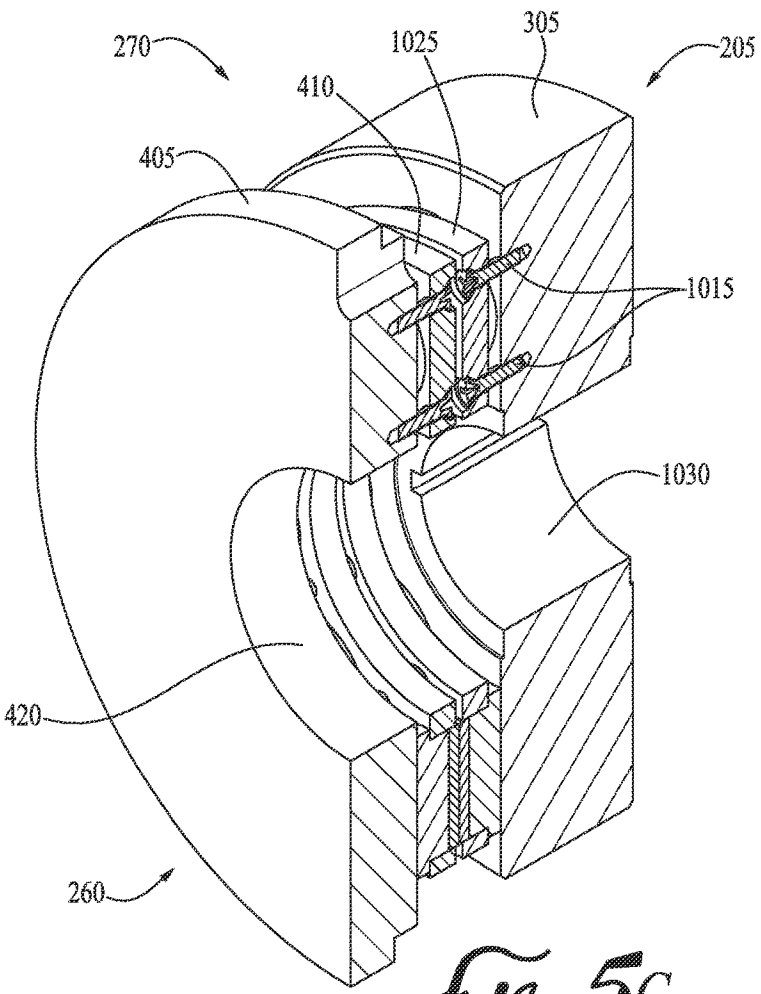
FIG. 5C is a cross sectional view taken along line 5C-5C of FIG. 5A of a bearing set of an illustrative embodiment.
Figure 5B:
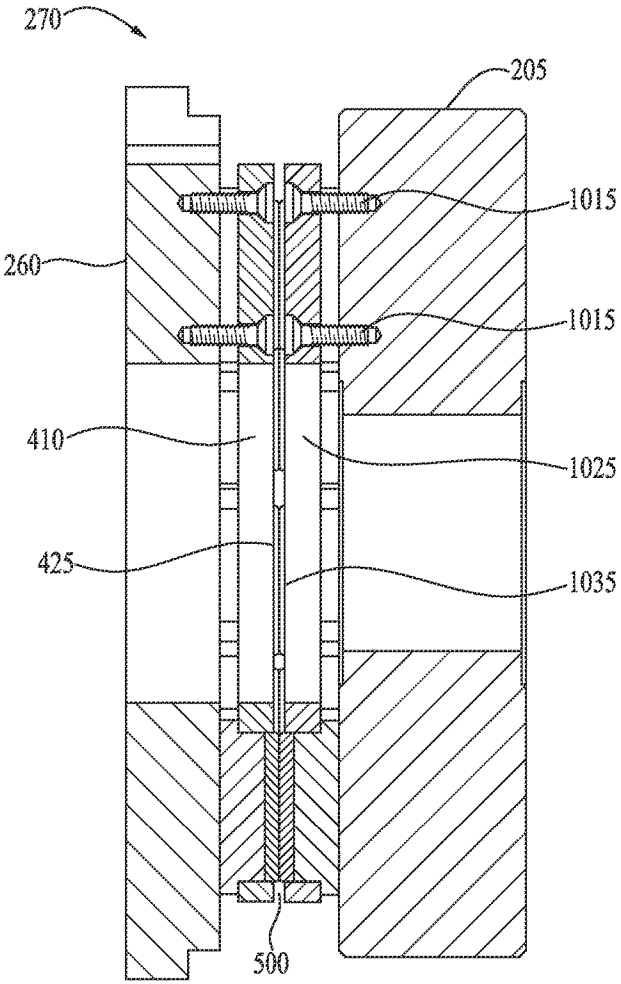
FIG. 5B is a cross sectional view taken along line 5B-5B of FIG. 5A of a bearing set of an illustrative embodiment.

FIGS. 5A, 5B and 5C are illustrative embodiments of thrust runner 205 paired with thrust bearing 260 to form bearing set 270. Faces 1035, 425 face towards each other, with space 500 in between them, space 500 sufficient to accommodate a hydrodynamic film. Space 500 may be between about 0.00001 to 0.005 inches separation due to temperature and fluid viscosity. Water and oil are considered incompressible fluids. As the velocity of thrust runner 205 increases, a fluid wedge may be created in space 500, which separates faces 1035, 425 from one another. The wedge may increase in height with the speed of rotating shaft 220 and thrust runner 205, providing greater load capacity. Thus, these illustrative embodiments reduce heat and friction in order to increase load capacity.

Figure 6:
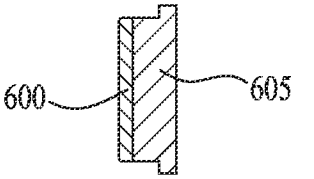
FIG. 6 is a sectional view of diamond coated pad of an illustrative embodiment.

FIG. 6 is an illustration of an exemplary pad of illustrative embodiments. Bearing pad 415 is illustrated in FIG. 6, but runner pad 1020 may similarly be as illustrated. Bearing and/or runner pad(s) 415, 1020 may be diamond coated, made of diamond, include leached diamond and/or comprise diamond. In some embodiments, bearing and runner pads 415, 1020 may comprise a polycrystalline matrix of inter-bonded, hard carbon-based crystals. For example, bearing and/or runner pads 415, 1020 may comprise a facing table of polycrystalline diamond integrally bonded to a substrate of less hard material, such as tungsten carbide and/or pad base 605, which pad base may be tungsten carbide. In embodiments including leached diamond, the leached diamond may include a polycrystalline matrix whereby the cobalt or other binder-catalyzing material in the polycrystalline diamond is leached out from the continuous interstitial matrix after formation.

Figure 7B:
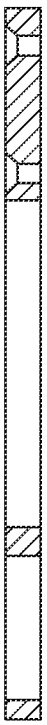
FIG. 7B is a cross sectional view taken along line 7B-7B of FIG. 7A of a locking plate of an illustrative embodiment.
Figure 7A:
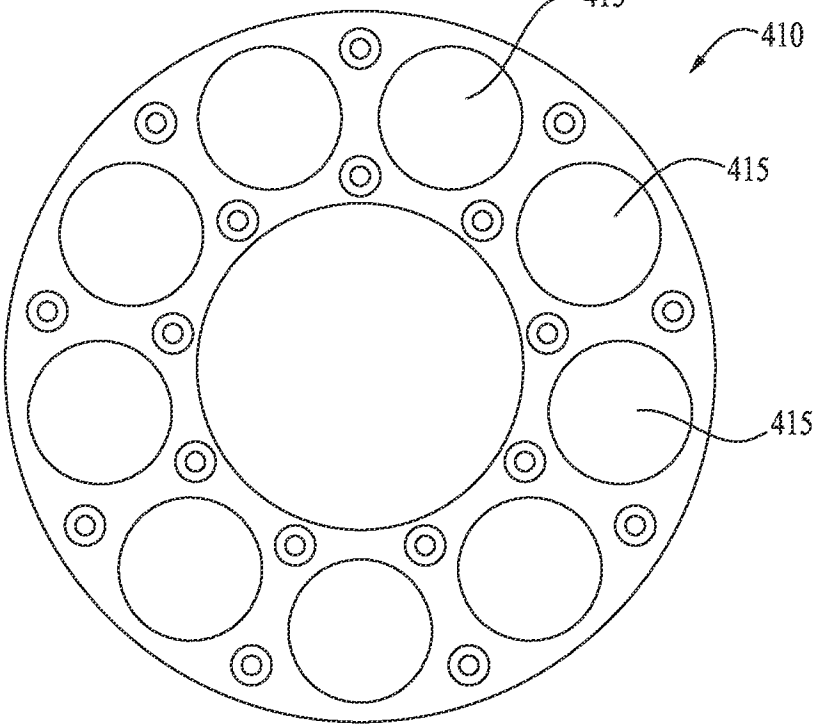
FIG. 7A is a schematic of a top view of a locking plate of an illustrative embodiment.

As shown in FIGS. 4, 7A and 10, bearing pad 415 and/or runner pad 1020 may have a circular cross-sectional area, or alternatively may have an elliptical or sector profile. Pad base 605 may be made of tungsten carbide and comprises a diamond coating 600. In certain embodiments, the diamond coating may be between about 0.070 and 0.080 inches thick, or may be between a few thousandths of an inch thick and 0.5 inch thick or more. In some embodiments, diamond coating 600 may be a diamond wafer that is silver brazed to pad base 605. In some embodiments, diamond coating 600 may be a diamond table.

Figure 8B:
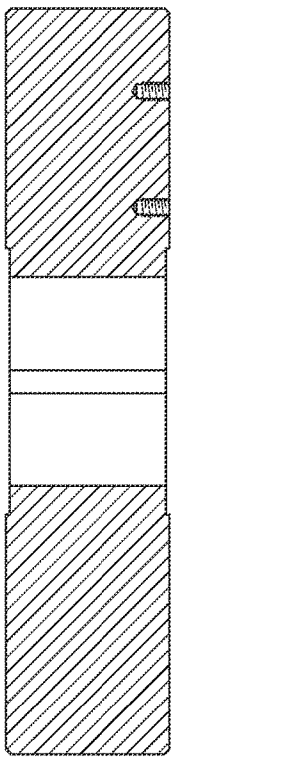
FIG. 8B is a cross sectional view taken along line 8B-8B of FIG. 8A of a thrust runner of an illustrative embodiment.
Figure 8A:
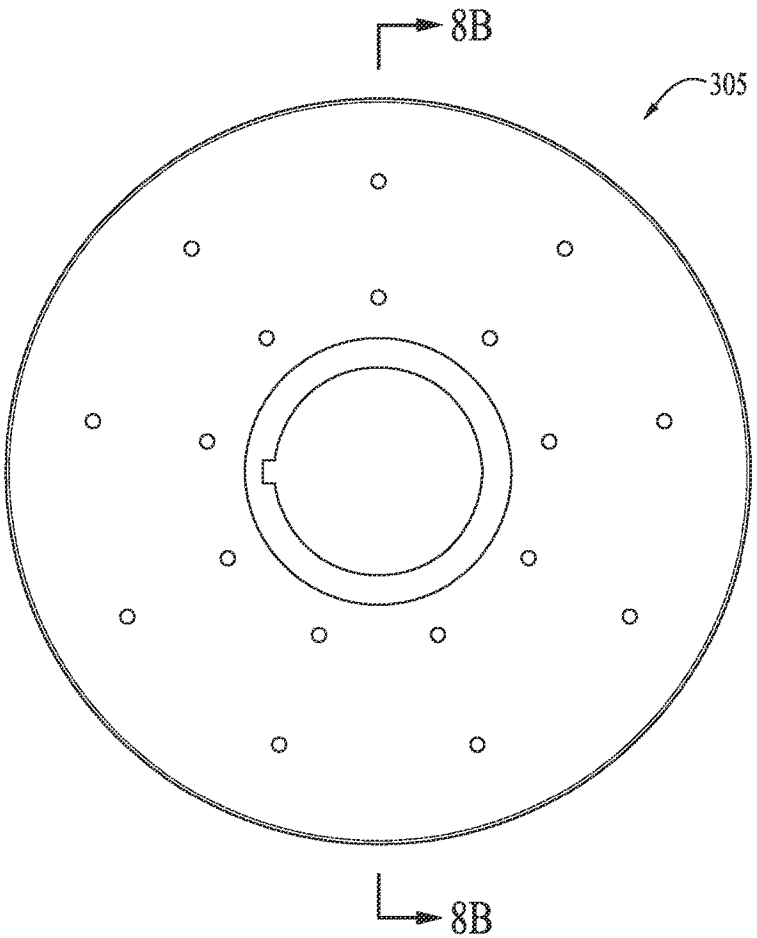
FIG. 8A is a top view of a thrust runner of an illustrative embodiment.
Figure 9B:
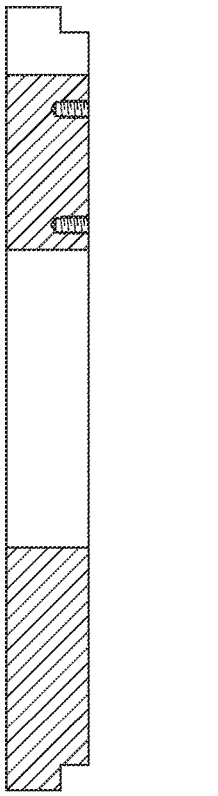
FIG. 9A is a top view of a thrust bearing of an illustrative embodiment.
FIG. 9 B is a cross sectional view taken along line 9B-9B of FIG. 9A of a thrust bearing of an illustrative embodiment.
Figure 9A:
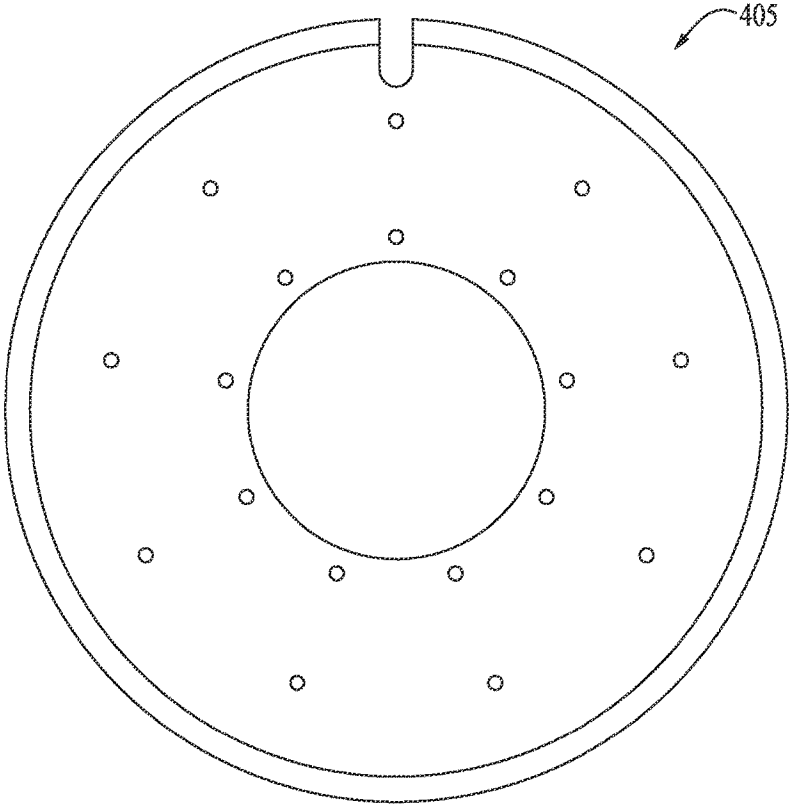

FIGS. 7A and 7B illustrate an exemplary embodiment of a locking plate. Bearing locking plate 410 is illustrated in FIGS. 7A and 7B, but runner locking plate 1025 may also be as illustrated. As shown in FIG. 7A, nine bearing pads 415 are evenly and circumferentially placed about locking plate 410. FIGS. 8A and 8B are an illustrative embodiment of runner base 305 of thrust runner 205. FIGS. 9A and 9B are an illustrative embodiment of bearing holder 405.

Operation of the Pump

Once the pump assembly has been positioned at the desired location, operation of the pump may be initiated. In instances where pumped fluid is employed as the hydrodynamic fluid, unlike motor oil, the water and/or pumped fluid may not provide boundary layer separation between faces 425 and 1035 when the ESP pump is first started. This is predominantly due to well fluid's relatively lower viscosity of about 1, the lack of additives in pumped fluid that would otherwise provide boundary layer lubrication and/or due to contaminants in the water or pumped fluid. Thus, water and/or pumped fluid would not typically be used as a hydrodynamic film in pump assemblies. As a result of the lack of lubrication, thrust runner 205 and thrust bearing 260 must endure contact of faces 425 and 1035 during pump start-up. Illustrative embodiments of thrust runner 205 and thrust bearing 260 are uniquely suited to solve this problem. Diamond coat 600 may endure face to face contact and prevent damage to thrust runner 205 and thrust bearing 260 prior to formation of the hydrodynamic film, due to the extreme hardness of diamond as employed in illustrative embodiments. Upon continued operation of the ESP pump, a hydrodynamic film may form in space 500 between faces 425, 1035 from the pumped fluid. In embodiments in which well fluid forms the hydrodynamic film, thrust runner 205 and thrust bearing 225 may handle increased axial loads due to the well fluid's improved heat transfer rate over motor oil which is used in traditional seals. In some embodiments, thrust runner 205 and thrust bearing 260, configured as described herein, may handle loads of about 5,000-10,000 pounds.

Motor Oil Vent Port

Figure 11:
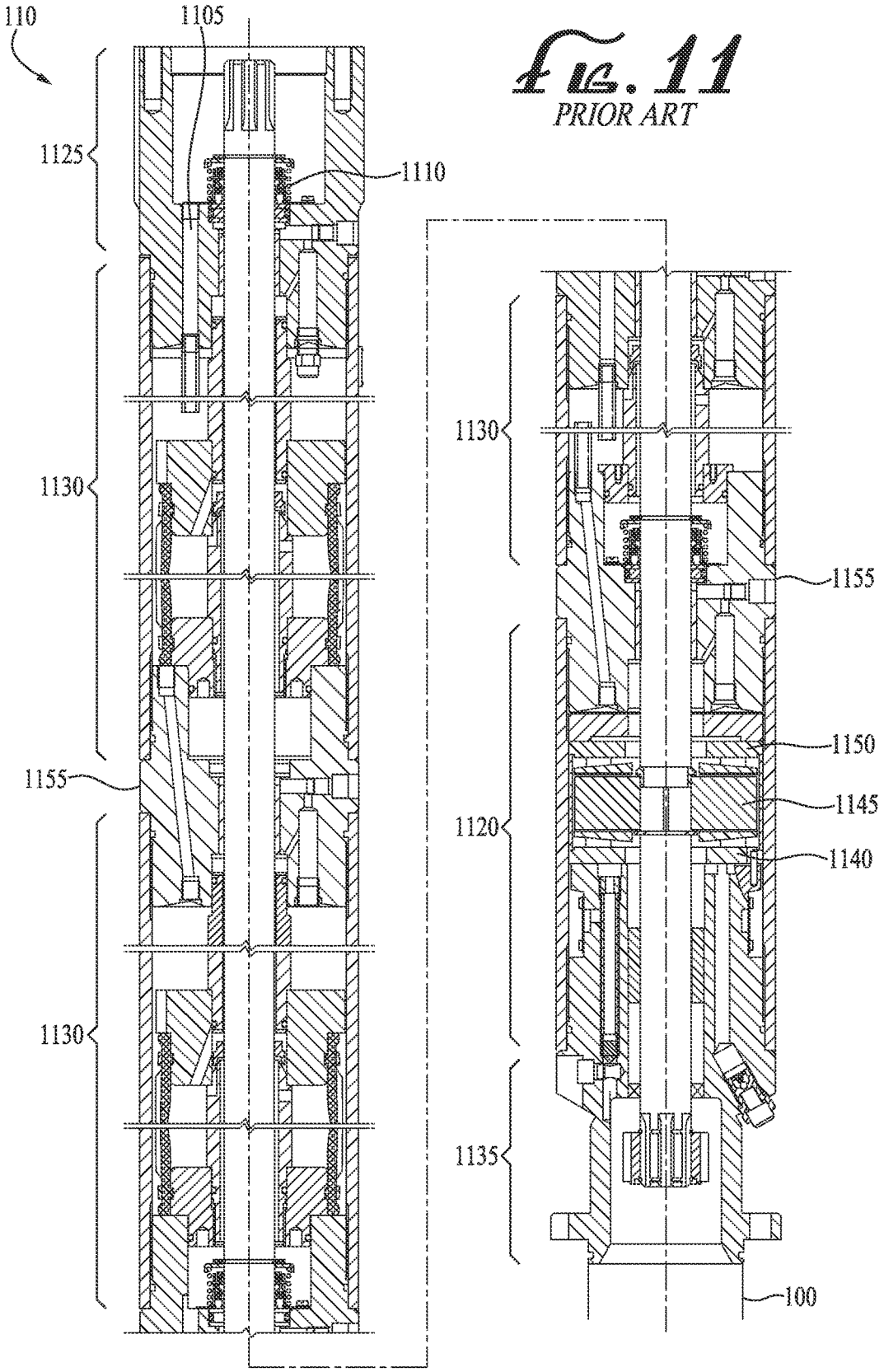
FIG. 11 PRIOR ART
FIG. 11 is a schematic of a conventional seal section of the prior art.
Figure 12B:
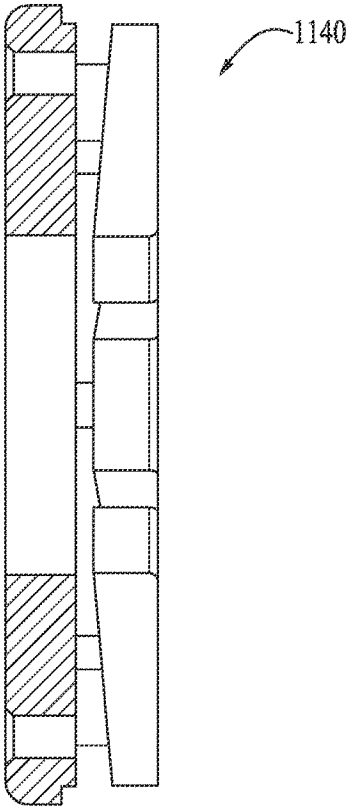
Fig. 12B PRIOR ART
FIG. 12B is a cross sectional view taken along line 12B-12B of FIG. 12A of a conventional thrust bearing of the prior art.
Figure 12A:
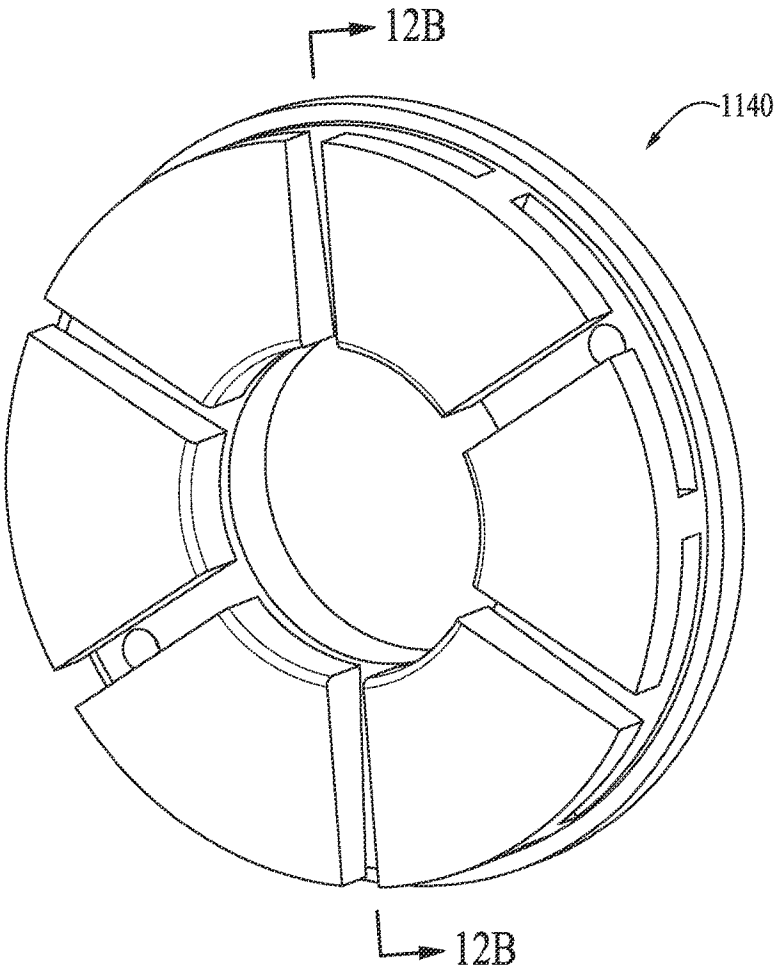
Fig. 12A PRIOR ART
FIG. 12A is a perspective view of a conventional thrust bearing of the prior art.

Returning to FIG. 2, vent port 290 may be located in the wall of head 280. This is in contrast to the conventional location at the bottom of the well bore as illustrated with conventional vent port 1105 in prior art FIG. 11. Moving vent port 290 from the well bore and connecting vent port 290 to communication port 295 radially through head 280 may prevent sand from plugging communication port 295 and/or decrease the amount of sand that accumulates on communication port 295. In addition, moving vent port 290 to the side of head 280, upstream of mechanical seal 250, eliminates or significantly reduces the risk that vent port 290 will clog with sand or other contaminants, which may reduce the risk of disturbing the pressure equalization of the seal and/or motor failure. As illustrated in FIGS. 2 and 3B, vent port 290 of illustrative embodiments may extend radially outward from communication port 295, and not extend substantially parallel to shaft 220, up through mechanical seal 250 as with conventional vent ports. As is well known to those of skill in the art, vent port 290 may include a check valve to allow expanding motor oil to exit seal section 200, but does not allow fluid to enter seal section 200.

Abrasion Resistant Trim

As shown in FIG. 3B, bushing set 310 may be comprised of sleeve 320 and bushing 315 located upstream of mechanical seal 250, in place of what would conventionally be a bronze shaft bushing. In some embodiments bushing set 310 comprises tungsten carbide. Sleeve 320 may be located on shaft 220 adjacent to bushing 315. In some embodiments, sleeve 320 rotates with shaft 220 by keying sleeve 320 to shaft 220. Sleeve 320 may be attached to the shaft using snap-rings at the top and/or bottom of sleeve 320. Sleeve 320 and bushing 315 may operate unimpeded in contaminated well fluid conditions in the present invention, whereas a bronze bushing of the prior art would fail under similar contamination. Bushing 315 may also provide radial shaft support. Even if mechanical seal 250 fails, bushing 315 may continue to provide radial shaft support, which might then prevent a failure of the pump assembly.

Seal Section Illustrative Embodiment

In some well applications, for example in tar sands, it may be desirable to place bearing set 270 in motor oil rather than well fluid, yet still keep bearing set 270 at the "top" of seal section 200 in head 280, which positioning may improve protection against shaft buckling and cooling characteristics. In one tar sand example, steam may be injected into a hole parallel to the well bore. Melted tar may seep into the well bore where the pump equipment is located. If bearing set 270 were exposed to well fluid in such a tar sand example, direct contact between bearing set 270 and melted tar may undesirably clog the area around bearing pad 415 openings and prevent cooling.

Figure 13:
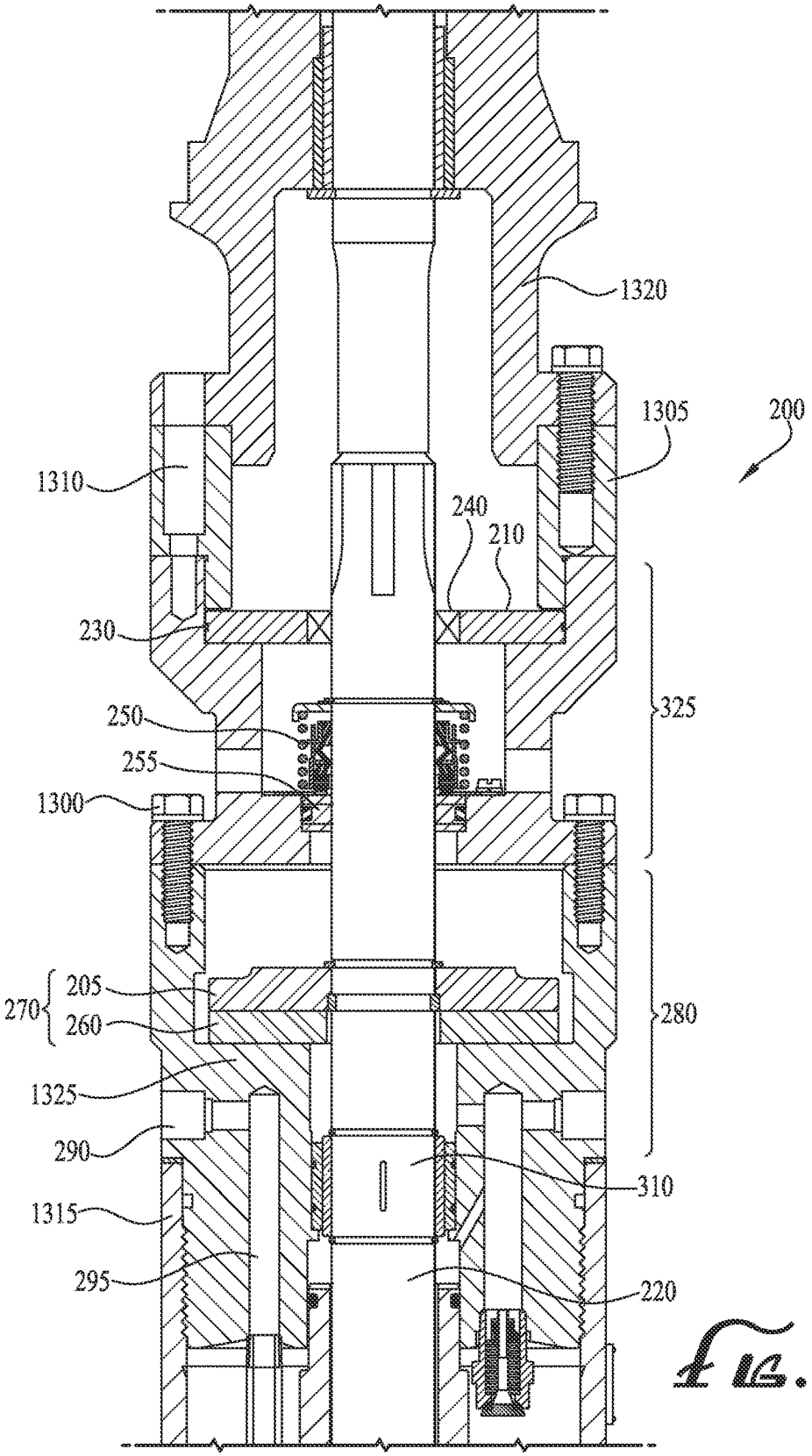
FIG. 13 is a sectional view of a seal section of an illustrative embodiment of a submersible pump assembly.

As shown in the embodiment of FIG. 13, bearing set 270 may be located in head 280 below mechanical seal 250 and in motor oil, rather than between sand barrier 210 and mechanical seal 250 in working fluid as shown in FIG. 2. To implement positioning of bearing set 270 below mechanical seal 250 in head 280, additional modifications to seal section 200 may be employed. Mechanical seal 250 may be removed from a conventional location in the head, and relocated within adapter 325. Mechanical seal 250 may be sealed to shaft 220 within adapter 325 as shown in FIG. 13, rather than within head 280 as shown in FIG. 2 or in a conventional mechanical seal location. In some embodiments, the diameter of adapter 325 may decrease around mechanical seal 250 in order to accommodate differences in diameter between seal section 200 and intake 1320. Adapter 325 and/or sand barrier stop 1305 of illustrative embodiments may increase the length of seal section 200 by a few inches, for example two to six inches longer than conventional seal sections. As a result the length of shaft 220 may also be increased by a few inches correspondingly.

Bearing set 270 may be secured within head 280 in the location reserved for mechanical seal 250 in the embodiment of FIG. 2. Specifically, bearing set 270 may be placed within head 280 at the top of seal section 200, just below adapter 325. Thrust bearing 260 may be pressed and/or secured to support 1325 of head 280 with an anti-roll pin, such that thrust bearing 260 does not rotate with shaft 220. The surface area of support 1325 may be increased as compared to the embodiment of FIG. 2, since there is no need to bore out the cavity to accommodate mechanical seal 250 at that location, which increased support 1325 may improve the stability of thrust bearing 260. The surface area of support 1325 in contact with thrust bearing 260 may be increased as compared to that of the embodiment of FIG. 2 to provide a most secure attachment for thrust bearing 260. Thrust runner 205 may be keyed by way of a machined keyway 1700 (shown in FIG. 17), pressure fit, or otherwise attached to shaft 220 such that thrust runner 205 rotates with shaft 220.

Sand barrier 210 may include axially oriented sand barrier stop 1305, which sand barrier stop 1305 may extend longitudinally downstream from sand barrier 210 at the outer diameter of sand barrier 210. Sand barrier stop 1305 may be attached on a downstream side to pump intake 1320, and on an upstream side to adapter 325. In sand barrier stop 1305 embodiments, sand barrier stop 1305 may wedge and/or sandwich sand barrier 210 in place rather than, or in addition to, adapter 325. As shown in FIG. 13, sand barrier 210 is wedged between sand barrier stop 1305 and adapter 325 at the outer diameter of sand barrier 210. Sand barrier stop 1305 may be attached to sand barrier 210 and/or adapter 325 with fasteners 1310 which may be bolts, threading, screws or another fastening means known to those of skill in the art. The outer circumference (outer diameter) of sand barrier 210 may be pressed against the inner side of adapter 325 and sealed with gasket 230, such as circular steel ring and/or an o-ring. Gasket 230 may be inserted into an o-ring groove in adapter 325, rather than head 280. The inner circumference (inner diameter) of sand barrier 210 may be sealed against shaft 220 with radial shaft seal 240 (lip seal) to prevent sand from leaking through the barrier while still allowing shaft 220 to rotate while sand barrier remains stationary. Sand barrier 210 may prevent sand, well fluid and/or other particulates carried in well fluid from bypassing the barrier and collecting on thrust bearing 260, thrust runner 205 and/or mechanical seal 250.

As opposed to the embodiment of FIG. 2, where adapter 325 is between intake 1320 and head 280, adapter 325 may instead be between sand barrier stop 1305 and head 280. Head 280 may be attached upstream of adapter 325—secured to adapter 325 on a downstream side, and seal section body 1315 on an upstream side. Bolts 1300, screws, threading or anther attachment means known to those of skill in the art may be employed to secure head 280 between adapter 325 and body 1315.

Figure 15B:
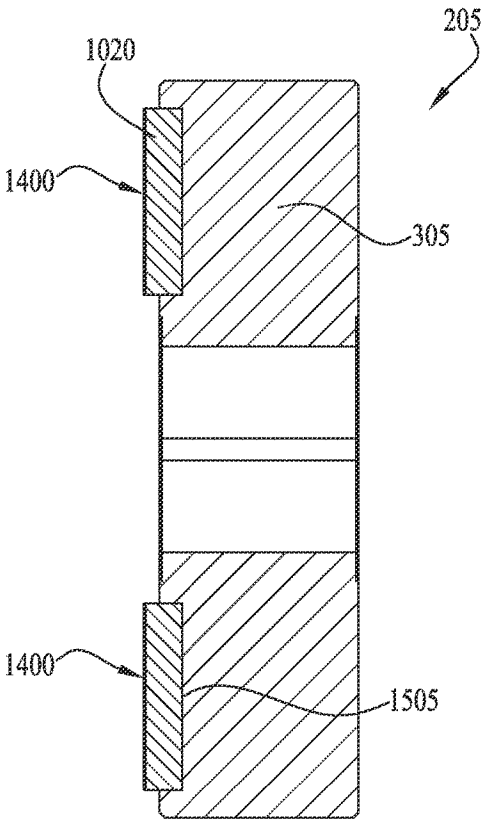
FIG. 15B is a cross sectional view across line 15B-15B of a thrust runner of an illustrative embodiment.
Figure 15A:
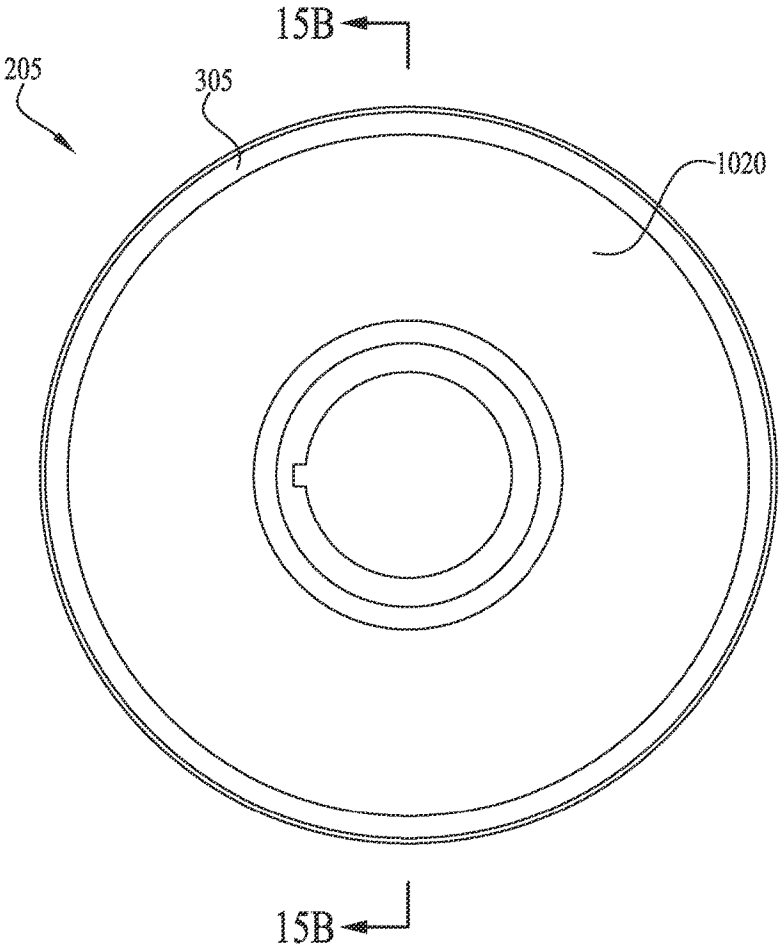
FIG. 15A is a top plan view of a thrust runner of an illustrative embodiment.
Figure 17:
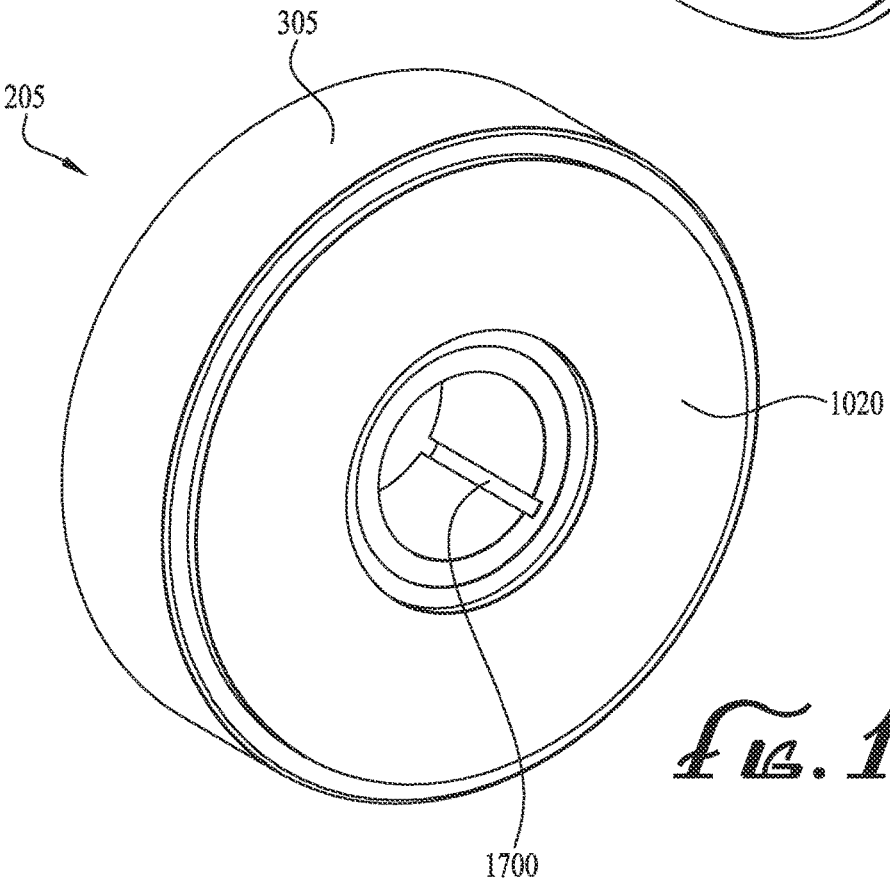
FIG. 17 is a perspective view of a thrust runner of an illustrative embodiment.

The design of thrust runner 205 and thrust bearing 260 may be as described previously herein. In certain embodiments, thrust runner 205 may be as shown in FIGS. 15A, 15B and FIG. 17. As shown in FIG. 15A, thrust runner 205 may include steel runner base 305. Runner base 305 may be undercut and/or milled out in face to form impression 1505 in the shape of a disc and/or donut. In one example, impression may be about ⅛$^{th}$ an inch in depth. A single tungsten carbide runner pad 1020 that interlocks with, fits within and/or is a mirror image of impression 1505 may be secured within the impression in base 305. Runner pad 1020 may held in place with screws 1015, pressure fit, brazed or another attachment mechanism known to those of skill in the art.

Figure 14B:
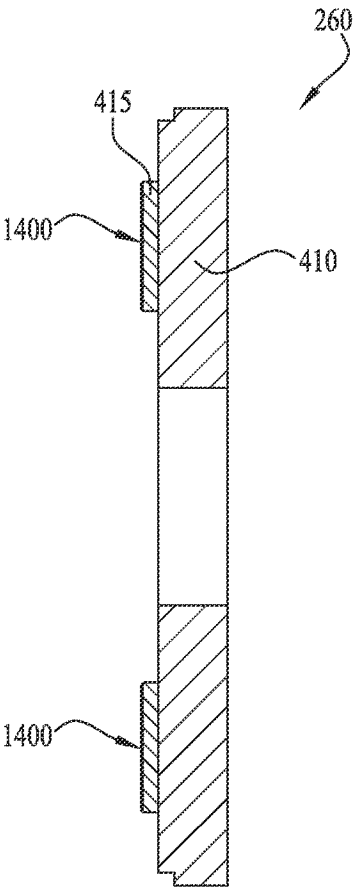
FIG. 14B is a cross sectional view across line 14B-14B of FIG. 14A of a thrust bearing of an illustrative embodiment.

The outer surface of runner pad 1020 and/or bearing pad 415 may be layered with a diamond vapor deposition layer 1400. In some embodiments, diamond deposition layer may be diamond coating 615 as described herein. In certain embodiments, diamond vapor deposition layer 1400 maybe between about three microns and six microns thick. FIGS. 14B and 15B illustrate an exemplary layer 1400 of illustrative embodiments. Layer 1400 may be a thin infusion, coating and/or film of diamond-like carbon (DLC) between about one and six microns in thickness. DLC coating may be a carbon compound having a combination of $SP^2$ (graphite) and $SP^3$ (diamond) carbon bonding and varying hydrogen content. Films with a higher $SP^3$ bonding content may be harder with a high level of abrasion resistance, but may be less ductile than films with higher $SP^2$ bonding content. DLC coating of illustrative embodiments may have a hardness of about 2500 on the Vickers scale, and a friction coefficient of DLC against DLC of about 0.15.

Layer 1400 may be applied using physical vapor deposition, plasma-assisted chemical vapor deposition, or a similar process. In one example, layer 1400, may be applied to runner pad 1020 and/or bearing pad 415 using physical vapor deposition in a vacuum at 350° C. In another example, layer 1400 may be applied to runner pad 1020 and/or bearing pad 415 using plasma-assisted chemical vapor deposition at 180° C. with a plasma nitride surface layer that is then overlaid with physical vapor deposition of DLC.

Figure 14A:
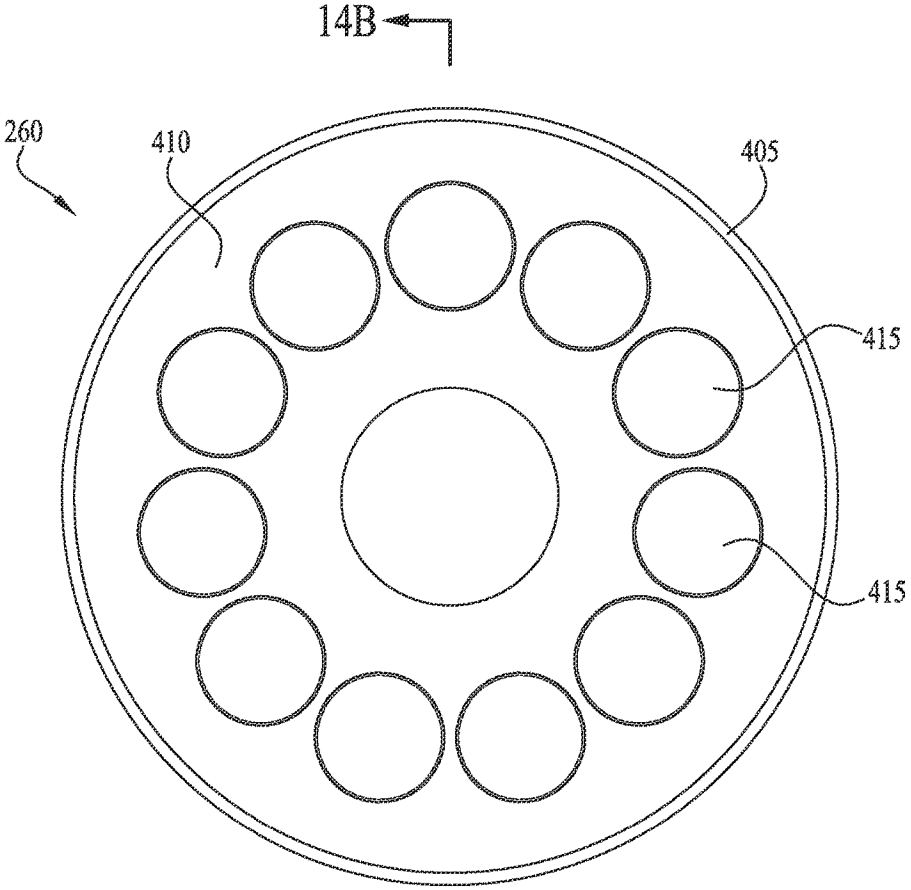
FIG. 14A is a top plan view of a thrust bearing of an illustrative embodiment.
Figure 16:
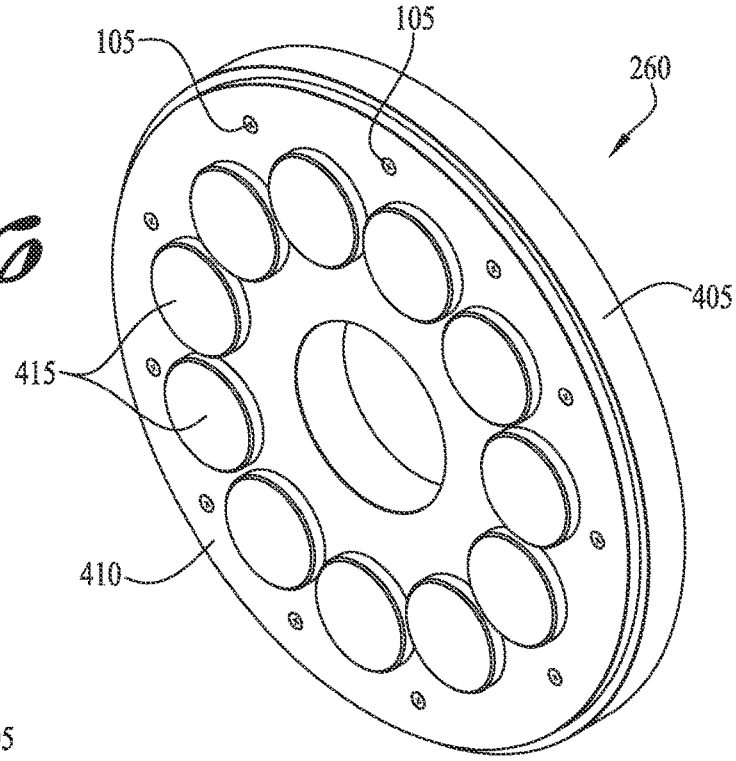
FIG. 16 is a perspective view of a thrust bearing of an illustrative embodiment.

As illustrated in FIG. 14B, layer 1400 may be employed on bearing pads 415 in addition to, or instead of, runner pads 1020. In the example of FIG. 16 and FIGS. 14A and 14B, bearing pads 415 may be arranged about bearing holder 405 and secured by locking plate 410. Layer 1400 may coat the surface of bearing pads 415 as described herein.

The inventions described herein may be suitable for a variety of types of seal sections 200. For ease of description, the embodiments described herein are in terms of an electrical submersible pump assembly, but those of skill in the art will recognize that the apparatus, system and method of the invention may be used to seal any type of electrical motor that may be exposed to fluid, sand and/or other contaminants. The inventions described herein prevent or reduce sand, well fluid and/or other contaminants from accumulating on mechanical seal 250 and/or bearing set 270, plugging vent port 290 and/or entering the electrical motor of a pump assembly. The risk of incipient buckling of the assembly may also be reduced or eliminated despite contaminated well fluid conditions (i.e., well fluid contaminated with sand). Illustrative embodiments described herein improve the thrust handling (thrust absorbing) capabilities of ESP pumps. The bearing pad(s) 415, runner pad(s) 1020, layer 1400 and/or diamond coating 605 on plate faces allow the thrust bearings of illustrative embodiments to be placed closer to the pump, away from the motor and/or eliminate the need for the bearings to be placed in a cavity of clean oil. Use of pumped fluid to act as a hydrodynamic film in space 500 between the bearings improves the heat and thrust absorbing capabilities of the bearings, improving the function of the pump assembly and increasing its lifespan. Other types of pump assemblies, such as horizontal surface pumps or other pumps requiring improved thrust handling capabilities may benefit from the apparatus, system and method of the invention. Those of ordinary skill in the art will recognize that the bearing set of illustrative embodiments may be implemented in other locations of a submersible pump assembly where bearings may be used, for example, the thrust chamber of a horizontal surface pump. Using the apparatus, systems and methods of the invention, well fluid may assist in cooling components of the seal section without contaminating the electrical motor or disturbing the pressure equalization function of the seal section.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A seal for an electric submersible pump assembly comprising a rotatable shaft extending axially through the seal section;

a head tubularly surrounding a top portion of the seal section and coupled to a centrifugal pump intake, wherein the head further comprises:

a mechanical seal, a well-fluid exit aperture proximate to the mechanical seal and extending radially through a wall of the head to the mechanical seal, wherein the well-fluid exit aperture flushes debris away from the mechanical seal, and a motor-oil vent port extending radially through the wall of the head and coupled to a communication port, the motor oil vent port located below the mechanical seal.

2. A seal section for an electric submersible pump assembly comprising:

a rotatable shaft extending axially through a seal section;

a top portion of the seal section comprising:

a sand barrier that blocks sand from accumulating on a mechanical seal, the sand barrier substantially sealed from leaks on an inner and outer diameter;

an adapter secured between a pump intake and a head of the seal section, the adapter holds the sand barrier in place;

the mechanical seal coupled to the rotatable shaft within the adapter and cooled by well fluid flowing through the adapter, and the head tubularly surrounding a bearing set in motor oil and coupled to a seal section housing;

wherein the bearing set further comprises:

a thrust bearing coupled to the head and a thrust runner keyed to the rotatable shaft.

3. The seal section of claim 2, wherein one of the thrust bearing or the thrust runner comprises a diamond-like carbon layer.

4. The seal section of claim 3, wherein the diamond-like carbon layer is a vapor deposition of diamond-like carbon.

5. The seal section of claim 2, wherein each of the thrust bearing and the thrust runner comprise a diamond-like carbon layer.

6. A seal section for an electric submersible pump assembly comprising:

a rotatable shaft extending axially through a seal section;

a top portion of the seal section comprising:

a sand barrier that blocks sand from accumulating on a mechanical seal, the sand barrier substantially sealed from leaks on an inner and outer diameter;

a sand barrier stop extending longitudinally and around the outer diameter of the sand barrier, the sand barrier stop coupled to a centrifugal pump intake, an adapter secured between the sand barrier stop and a head, the sand barrier wedged between the sand barrier stop and the adapter, the mechanical seal coupled to the rotatable shaft within the adapter and cooled by well fluid flowing through the adapter, and;

the head tubularly surrounding a bearing set in motor oil and coupled to a seal section body;

wherein the bearing set further comprises:

a thrust bearing coupled to the head and a thrust runner keyed to the rotatable shaft.

7. The seal section of claim 6, wherein the thrust runner comprises:

a base comprising a disc-shaped impression;

a runner pad fit within the impression; and a diamond-like carbon layer on an outer surface of the runner pad.

8. The seal section of claim 7, wherein the thrust bearing comprises:

a plurality of bearing pads secured circumferentially about a bearing holder with a locking plate; and a diamond-like carbon layer on an outer surface of each of the plurality of bearing pads.

9. The seal section of claim 6, wherein the sand barrier is coupled to the rotatable shaft on an inner diameter and the adapter on an outer diameter.

10. The seal section of claim 6, wherein the outer diameter of the sand barrier is sandwiched between the sand barrier stop and the adapter.

11. The seal section of claim 6, further comprising a motor-oil vent port located upstream of the mechanical seal and extending radially through a wall of the head from a communication port.

12. The seal section of claim 6, wherein the thrust bearing is pressed into a shelf of the head.

13. A electric submersible pump (ESP) system for pumping solid-laden fluid comprising:

a top portion of a seal section secured on a downstream side to an ESP intake, the top portion comprising:

a sand barrier portion defined by a sand barrier stop, the sand barrier stop secured between the ESP intake and an adapter portion, the sand barrier portion comprising a sand barrier that prevents sand from accumulating on a mechanical seal, the sand barrier sealedly coupled to a rotatable shaft on an inner diameter and sandwiched between the sand barrier stop and the adapter portion on an outer diameter, the adapter portion tubularly encasing the mechanical seal cooled by well fluid flowing through the adapter portion, the adapter portion secured between the sand barrier portion and a head portion, and the head portion secured between the adapter portion and a seal section housing, the head portion comprising a bearing set in motor oil, the bearing set comprising:

a thrust bearing and a thrust runner, wherein each of the thrust bearing and the thrust runner comprises at least one pad; and the at least one pad of each of the thrust bearing and the thrust runner comprising a diamond-like carbon (DLC) layer on an outer surface such that the DLC layer on the thrust bearing faces the DLC layer on the thrust runner.

14. The system of claim 13, further comprising a check valve extending radially through a wall of the head, the check valve fluidly coupled to a communication port and configured to vent expanding motor oil.

15. The system of claim 13, wherein the DLC layer is one of a physical vapor deposition or a plasma-assisted chemical vapor deposition.

16. The system of claim 13, wherein the at least one pad of the thrust runner is a single disc-shaped runner pad.

17. The system of claim 16, wherein the at least one pad of the thrust bearing is a plurality of bearing pads dispersed circumferentially about a bearing holder and secured by a locking plate.

18. An apparatus for absorbing a thrust of an electric submersible pump (ESP) comprising:

an ESP configured to pump a well fluid;

an electric motor operatively coupled to the ESP, the motor operating to rotate a shaft of the ESP;

a seal section located between the ESP and the motor, the seal section comprising:

a thrust bearing comprising a plurality of bearing pads, wherein each of the plurality of bearing pads has a deposition diamond-like carbon film on an outer surface of the bearing pad, the deposition diamond-like carbon film having a thickness of between one and six microns, and a thrust runner paired with the thrust bearing to form a bearing set, wherein the thrust runner rotates with the shaft, the thrust runner comprising having a single disc shaped runner pad secured within an impression in a thrust runner base, wherein the single pad has a deposition diamond-like carbon film on an outer surface of the single runner pad, the deposition diamond-like carbon film having a thickness of between one and six microns;

wherein the bearing set is located in a head in a top portion of the seal section;

wherein the head is secured between an adapter and a seal section housing, and wherein the adapter comprises a mechanical seal;

wherein the adapter is secured between the head and a sand barrier stop.

19. The apparatus of claim 18, wherein the plurality of bearing pads are arranged around a face of the thrust bearing.

20. The apparatus of claim 18, wherein the deposition diamond-like carbon film on the outer surface of the bearing pads and the runner pad is a physical vapor deposition film.

21. The apparatus of claim 18, wherein the deposition diamond-like carbon film on the outer surface of the bearing pads and the runner pad is a plasma-assisted chemical vapor deposition film.

22. The apparatus of claim 18, wherein the sand barrier stop is secured to an intake of the ESP.

* * * * *